US011786014B2

(12) United States Patent
Chang et al.

(10) Patent No.: US 11,786,014 B2
(45) Date of Patent: Oct. 17, 2023

(54) METHOD FOR MAKING MOISTURE-PERMEABLE WATERPROOF SHOE HAVING INTEGRALLY FORMED UPPER

(71) Applicants: Chung-Hao Chang, Taichung (TW); Chia-Ying Chang, Taichung (TW)

(72) Inventors: Chung-Hao Chang, Taichung (TW); Chia-Ying Chang, Taichung (TW)

( * ) Notice: Subject to any disclaimer, the term of this patent is extended or adjusted under 35 U.S.C. 154(b) by 177 days.

(21) Appl. No.: 17/374,629

(22) Filed: Jul. 13, 2021

(65) Prior Publication Data

US 2022/0338598 A1 Oct. 27, 2022

(30) Foreign Application Priority Data

Apr. 23, 2021 (TW) ..... 11011471.2

(51) Int. Cl.

| | |
|---|---|
| ***A43D 95/02*** | (2006.01) |
| *A43B 9/12* | (2006.01) |
| *A43B 23/22* | (2006.01) |
| *A43B 23/07* | (2006.01) |
| *A43B 7/12* | (2006.01) |

(52) U.S. Cl.

CPC ..... *A43D 95/02* (2013.01); *A43B 7/125* (2013.01); *A43B 9/12* (2013.01); *A43B 23/07* (2013.01); *A43B 23/22* (2013.01)

(58) Field of Classification Search

CPC ..... A43D 95/02; A43B 9/12; A43B 23/22; A43B 23/07; A43B 7/125

USPC ..... 12/146 C

See application file for complete search history.

(56) References Cited

U.S. PATENT DOCUMENTS

| | | | | |
|---|---|---|---|---|
| 3,720,971 | A * | 3/1973 | Wyness | A43D 8/006 12/146 C |
| 8,864,697 | B1 * | 10/2014 | Baker | A61F 5/0127 128/882 |
| 9,867,411 | B2 * | 1/2018 | Gallagher | A41D 19/001 |
| 10,470,517 | B2 * | 11/2019 | Chang | A43B 19/00 |
| 10,966,487 | B2 * | 4/2021 | Chang | A43B 23/022 |
| 11,058,178 | B2 * | 7/2021 | Chang | A43B 23/07 |
| 11,400,673 | B2 * | 8/2022 | Adami | B29D 35/12 |
| 11,484,091 | B2 * | 11/2022 | Issler | G01M 3/103 |
| 2002/0128573 | A1 * | 9/2002 | Caselnova | A61F 7/02 607/96 |
| 2003/0029058 | A1 * | 2/2003 | Lin | A43B 23/07 36/55 |
| 2003/0131498 | A1 * | 7/2003 | Liang | A43B 19/00 36/55 |

(Continued)

*Primary Examiner* — Timothy K Trieu
*Assistant Examiner* — Dakota Marin
(74) *Attorney, Agent, or Firm* — Muncy, Geissler, Olds & Lowe, P.C.

(57) ABSTRACT

A method for making a moisture-permeable waterproof shoe includes: (A) sleeving an inner sleeve unit on a last; (B) coating a bonding agent on an inner surface of an upper unit; (C) sleeving the upper unit on an assembly of the inner sleeve unit and the last; (D) placing an assembly of the upper unit, the inner sleeve unit and the last in a heating device; (E) placing the assembly in a vacuum bag; (F) placing the vacuum bag in a freezing device; (G) removing the assembly from the vacuum bag; (H) pulling out the last from the inner sleeve unit; and (I) fixing a sole to a bottom portion of a three-dimensional upper structure.

8 Claims, 27 Drawing Sheets

(56) References Cited

U.S. PATENT DOCUMENTS

| | | | | |
|---|---|---|---|---|
| 2013/0174443 | A1* | 7/2013 | Mankowski | A43B 7/34 36/10 |
| 2014/0082905 | A1* | 3/2014 | Wen | D04B 21/16 28/165 |
| 2015/0189952 | A1* | 7/2015 | Liang | B29D 35/148 12/146 C |
| 2015/0335097 | A1* | 11/2015 | Bisson | A43B 23/022 36/3 R |
| 2015/0342296 | A1* | 12/2015 | Skaja | A43B 9/12 36/83 |
| 2016/0113356 | A1* | 4/2016 | Clough | A41B 11/00 36/71.5 |
| 2018/0015686 | A1* | 1/2018 | Chang | B32B 5/26 |
| 2018/0153257 | A1* | 6/2018 | Chang | A43C 11/1493 |
| 2020/0245712 | A1* | 8/2020 | Lai | A43B 19/00 |
| 2021/0127796 | A1* | 5/2021 | Hsiao | A43B 9/12 |
| 2022/0225726 | A1* | 7/2022 | Wang | A43B 23/0235 |

* cited by examiner

METHOD FOR MAKING MOISTURE-PERMEABLE WATERPROOF SHOE HAVING INTEGRALLY FORMED UPPER

CROSS-REFERENCE TO RELATED APPLICATION

This application claims priority to Taiwanese Patent Application No. 110114712, filed on Apr. 23, 2021.

FIELD

The disclosure relates to a shoe, more particularly to a method for making a moisture-permeable waterproof shoe having an integrally formed upper.

BACKGROUND

Referring to FIGS. 1 and 2, a conventional shoe is generally made by first sewing together an upper 1 and a midsole cardboard 2 to form a three-dimensional (3D) upper structure 3, after which a last 4 is inserted into an interior space 301 of the 3D upper structure 3, and finally, a sole 4 is adhered to the 3D upper structure 3, thereby forming the conventional shoe.

However, to sew together the upper 1 and the midsole cardboard 2 having different materials is labor-intensive. Further, the conventional shoe has many components, so that the manufacturing cost thereof is increased. Moreover, the interior space 301 has a volume exactly corresponding to a volume of the last 4 that is inserted therein. After the last 4 is pulled out from the upper, the volume of the 3D upper structure 3 will remain corresponding to the size of the last 4 and will not shrink, so that the conventional shoe does not cover well a foot of a user during wear thereof, and is thus uncomfortable to wear.

SUMMARY

Therefore, an object of the present disclosure is to provide a method for making a moisture-permeable waterproof shoe having an integrally formed upper that is capable of alleviating at least one of the drawbacks of the prior art.

Accordingly, a method for making a moisture-permeable waterproof shoe of this disclosure includes:

(A) sleeving a shoe-shaped inner sleeve unit, which is moisture-permeable and waterproof and which defines a foot space having a top open end, on a forming portion of a last such that the forming portion of the last is inserted into the foot space through the top open end thereof, the foot space having a volume smaller than a forming volume of the forming portion by 5 to 10%;

(B) coating a bonding agent on an inner surface of an upper unit which defines an interior space having a top open end;

(C) sleeving the upper unit on an assembly of the shoe-shaped inner sleeve unit and the last such that the assembly of the shoe-shaped inner sleeve unit and the last is inserted into the interior space through the top open end thereof, the interior space having a volume smaller than the forming volume of the forming portion by 5 to 10%;

(D) placing an assembly of the upper unit, the shoe-shaped inner sleeve unit and the last in a heating device to heat the assembly of the upper unit, the shoe-shaped inner sleeve unit and the last to a predetermined heating temperature and a predetermined heating time;

(E) removing the assembly of the upper unit, the shoe-shaped inner sleeve unit and the last from the heating device, and then placing the assembly of the upper unit, the shoe-shaped inner sleeve unit and the last in a vacuum bag, after which air is evacuated from the vacuum bag for a predetermined vacuum time;

(F) placing the vacuum bag, which contains the assembly of the upper unit, the shoe-shaped inner sleeve unit and the last, in a freezing device to freeze the vacuum bag to a predetermined freezing temperature and a predetermined freezing time;

(G) removing the vacuum bag from the freezing device, and then removing the assembly of the upper unit, the shoe-shaped inner sleeve unit and the last from the vacuum bag;

(H) pulling out the last from the shoe-shaped inner sleeve unit, the upper unit and the shoe-shaped inner sleeve unit forming a three-dimensional moisture-permeable waterproof upper structure after the last is pulled out; and (I) fixing a sole to a bottom portion of the three-dimensional moisture-permeable waterproof upper structure.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 3A:
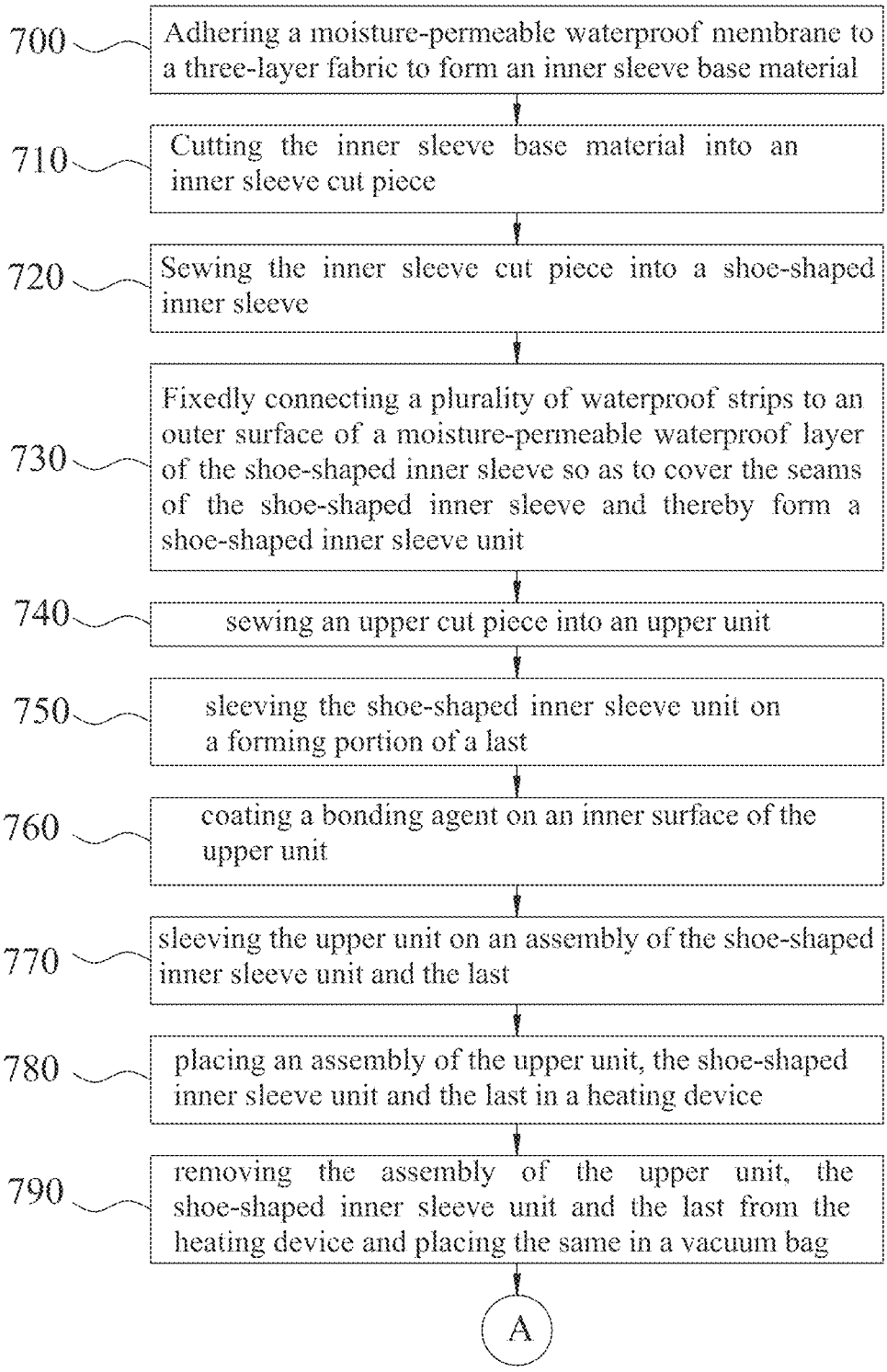
FIGS. 3A and 3B are flow charts, illustrating the steps involved in a method for making a moisture-permeable waterproof shoe according to an embodiment of the present disclosure.
Figure 3B:
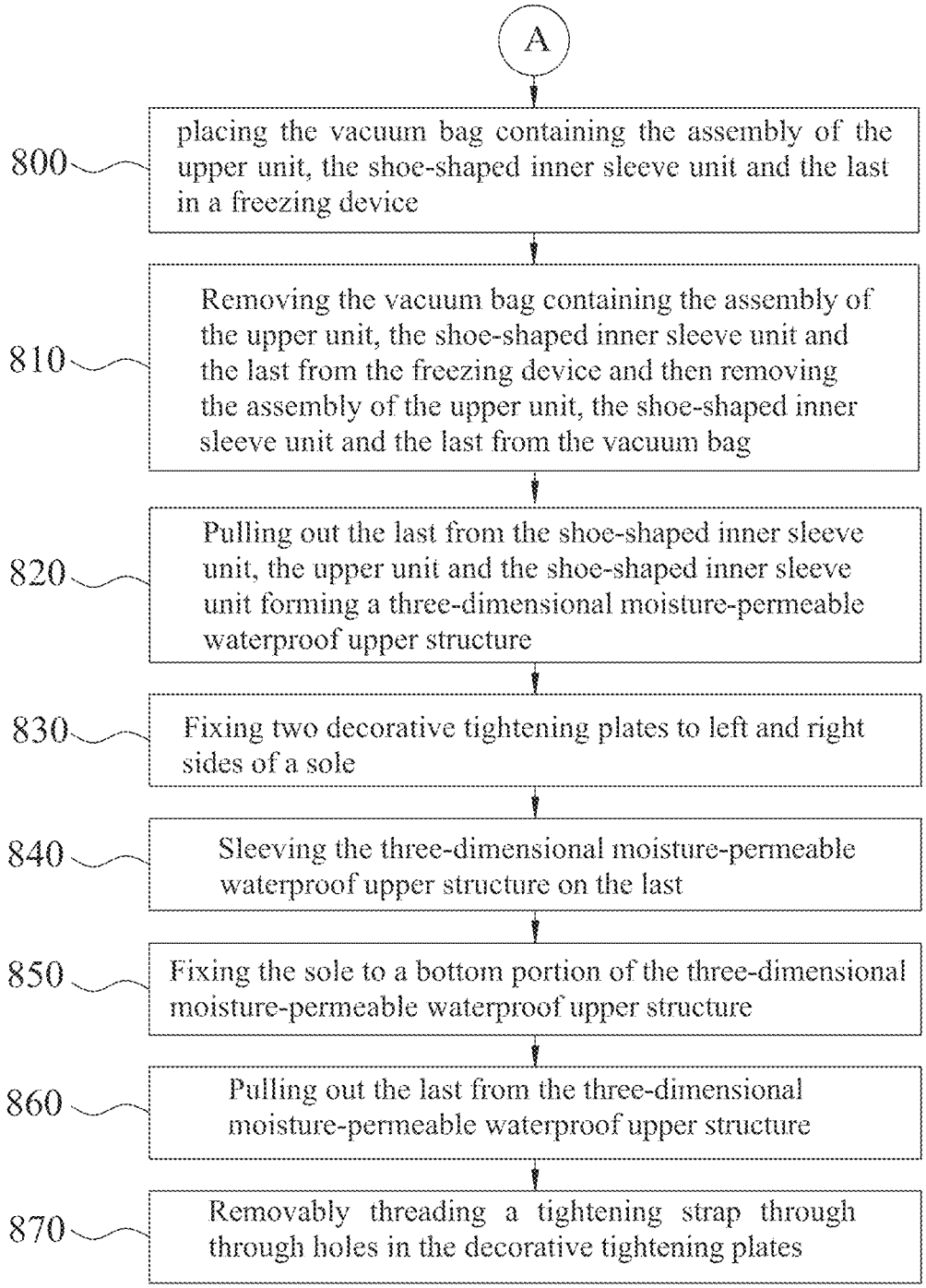
Figure 4:
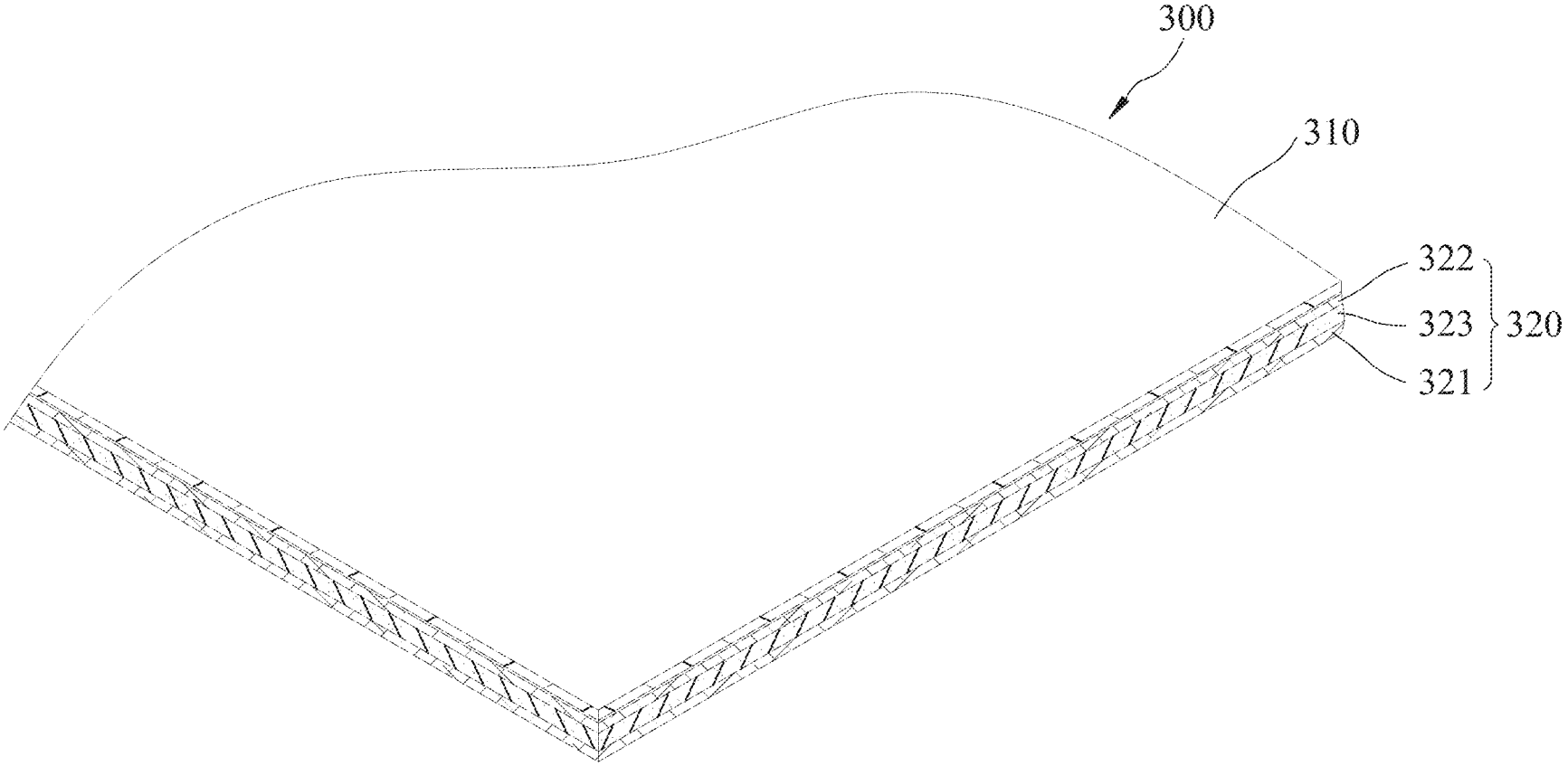
FIG. 4 is an enlarged fragmentary sectional view of an inner sleeve base material used by the embodiment.

Referring to FIGS. 3A and 3B, a method for making a moisture-permeable waterproof shoe 100 according to an embodiment of the present disclosure includes the following steps:

Step 700: adhering a moisture-permeable waterproof membrane 310 to a three-layer fabric 320 to form an inner sleeve base material 300, as shown in FIG. 4. The three-layer fabric 320 includes a fabric lining layer 321, an outer fabric layer 322, and a foam layer 323 fixed between the fabric lining layer 321 and the outer fabric layer 322. The moisture-permeable waterproof membrane 310 is fixedly adhered to an outer surface of the outer fabric layer 322.

Figure 5:
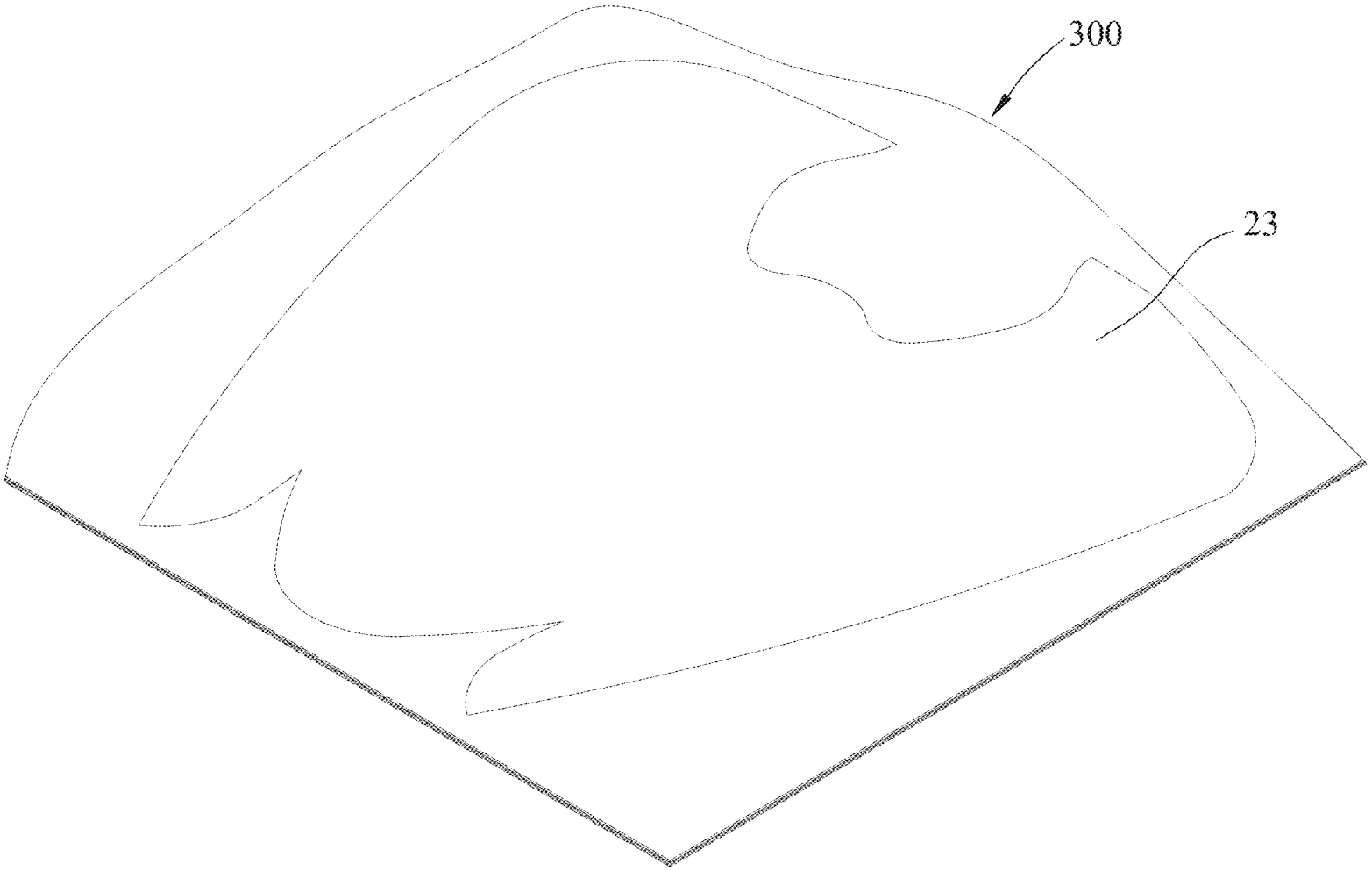
FIG. 5 is a fragmentary perspective view of the inner sleeve base material, illustrating how the inner sleeve base material is cut to form an inner sleeve cut piece.
Figure 6:
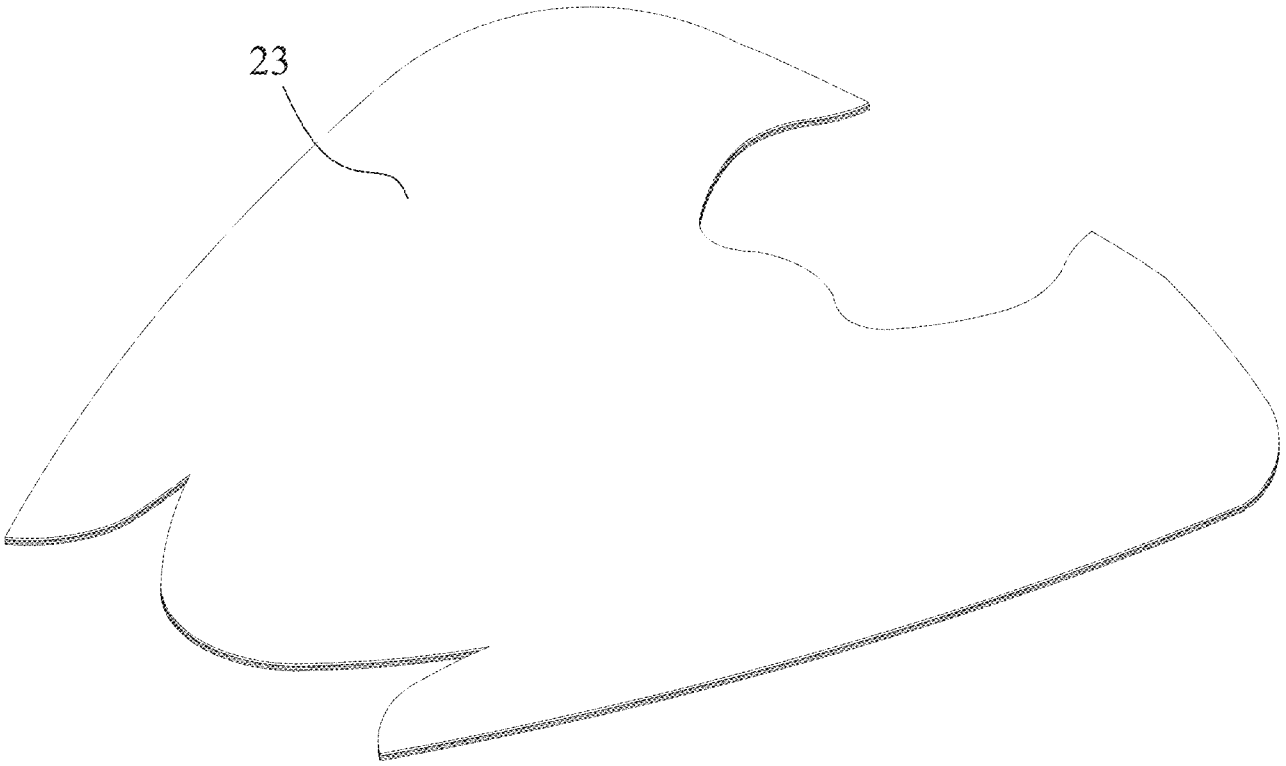
FIG. 6 is a perspective view of the inner sleeve cut piece.

Step 710: cutting the inner sleeve base material 300 into an inner sleeve cut piece 23, as shown in FIGS. 5 and 6. The inner sleeve cut piece 23 includes a fabric lining layer 231 taken from the fabric lining layer 321, an outer fabric layer 232 taken from the outer fabric layer 322, a foam layer 233 taken from the foam layer 323, and a moisture-permeable waterproof layer 234 taken from the moisture-permeable waterproof membrane 310.

Figure 7:
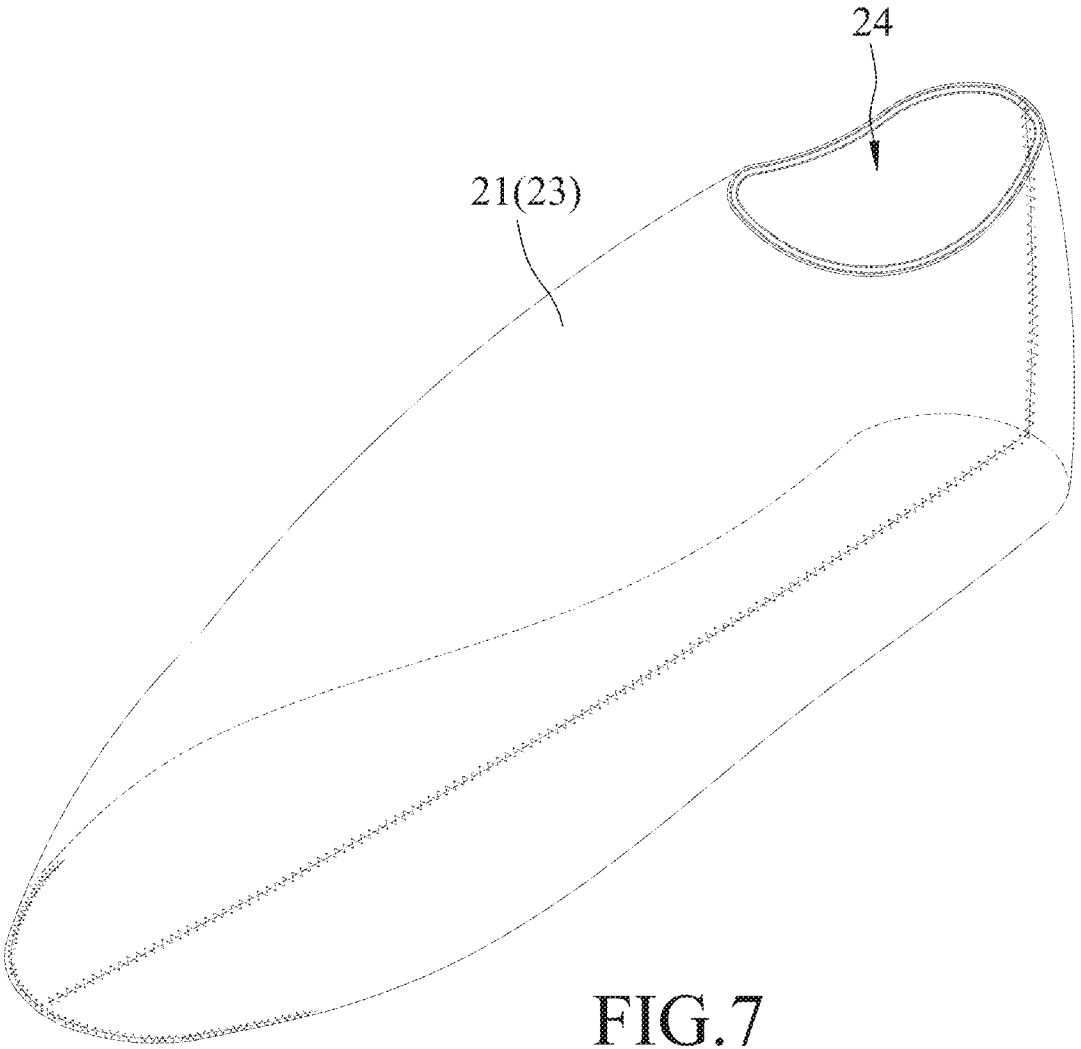
FIG. 7 illustrates how the inner sleeve cut piece is sewn to form a shoe-shaped inner sleeve.

Step 720: sewing the inner sleeve cut piece 23 into a shoe-shaped inner sleeve 21, as shown in FIGS. 6 and 7. The shoe-shaped inner sleeve 21 defines a foot space 24 having a top open end.

Figure 8:
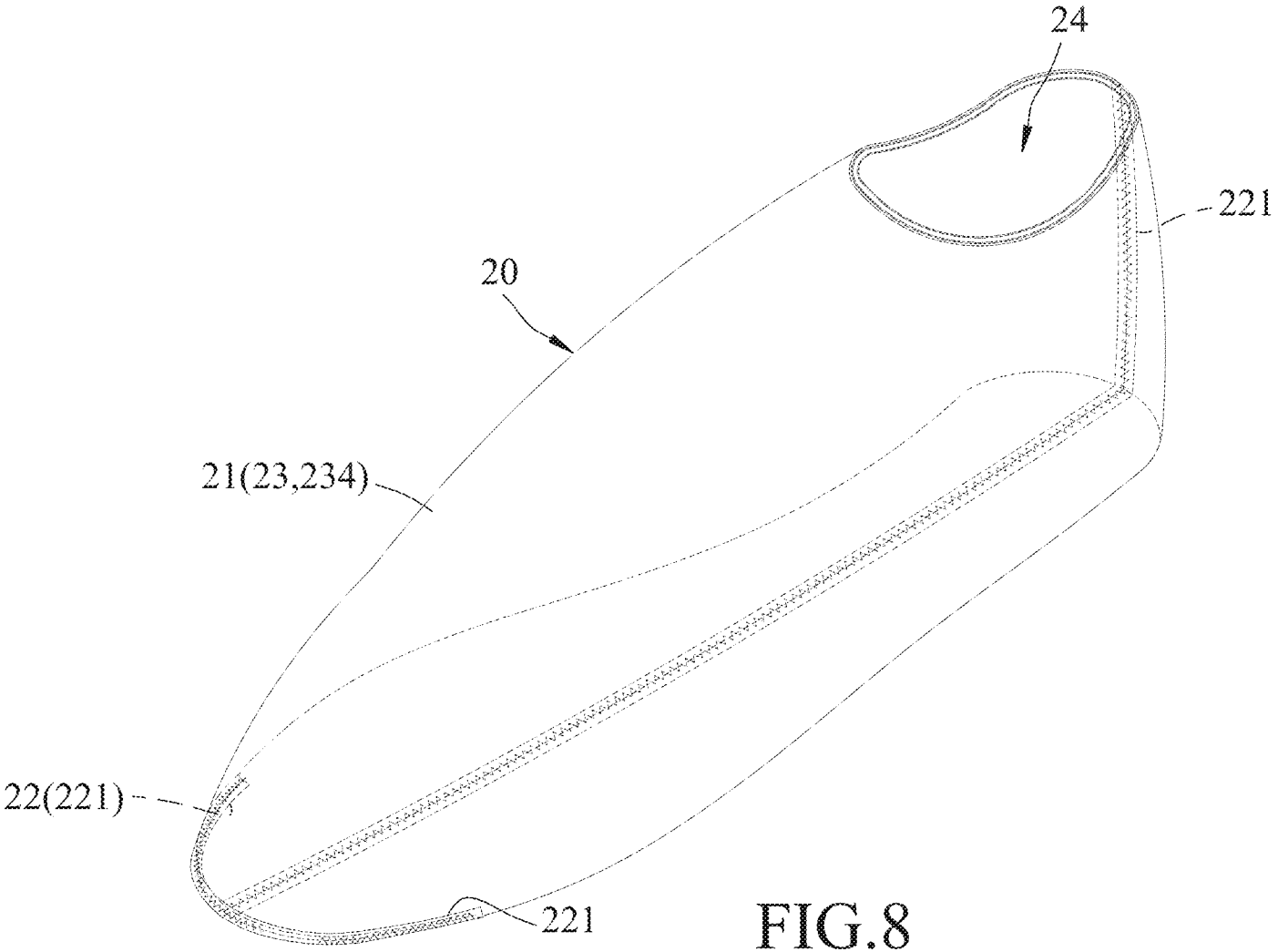
FIG. 8 is a view similar to FIG. 7, but illustrating a plurality of waterproof strips being fixedly connected to an outer surface of the shoe-shaped inner sleeve so as to cover the seams thereof and form a shoe-shaped inner sleeve unit.
Figure 9:
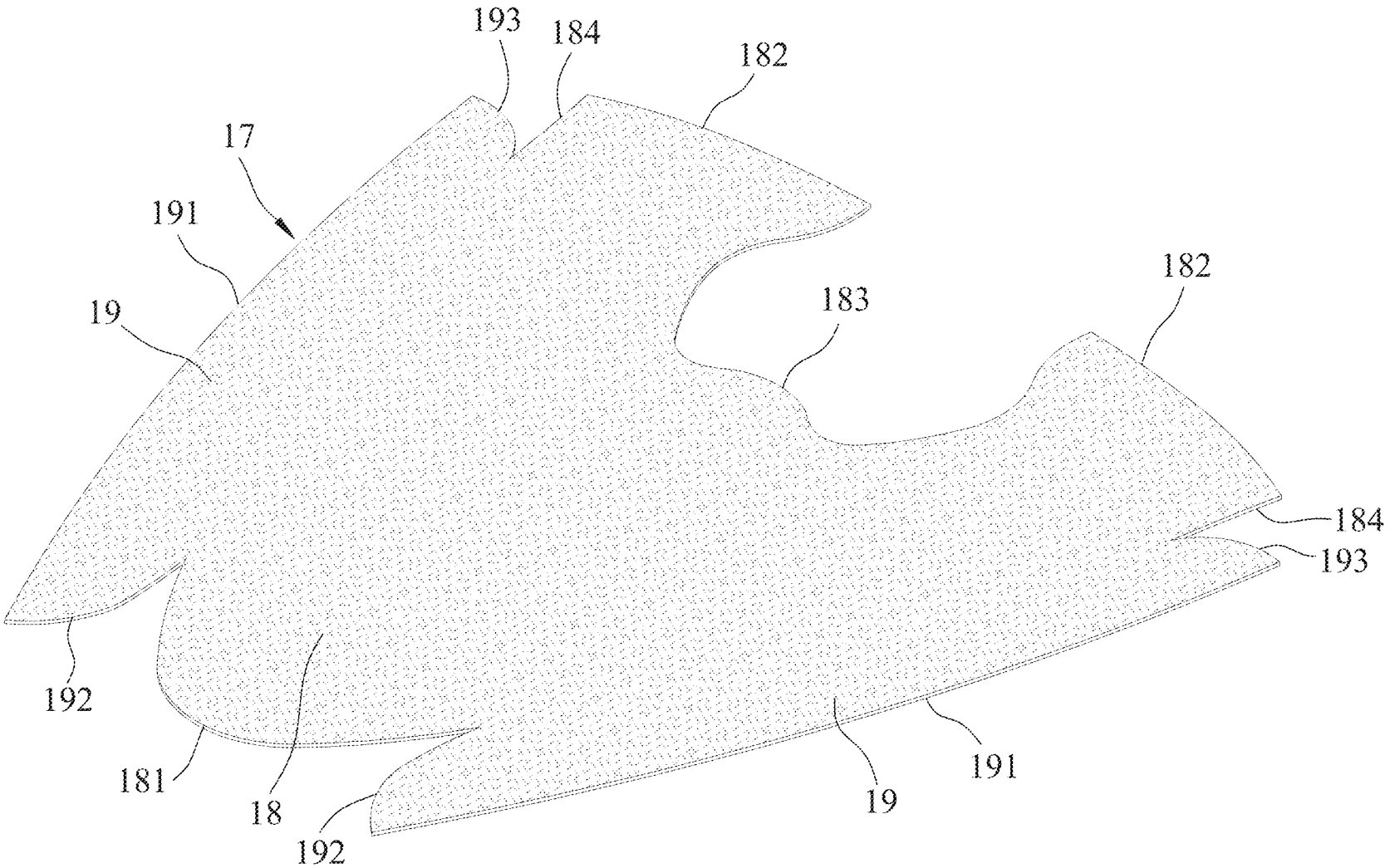
FIG. 9 is a perspective view of an upper cut piece used by the embodiment.
Figure 10:
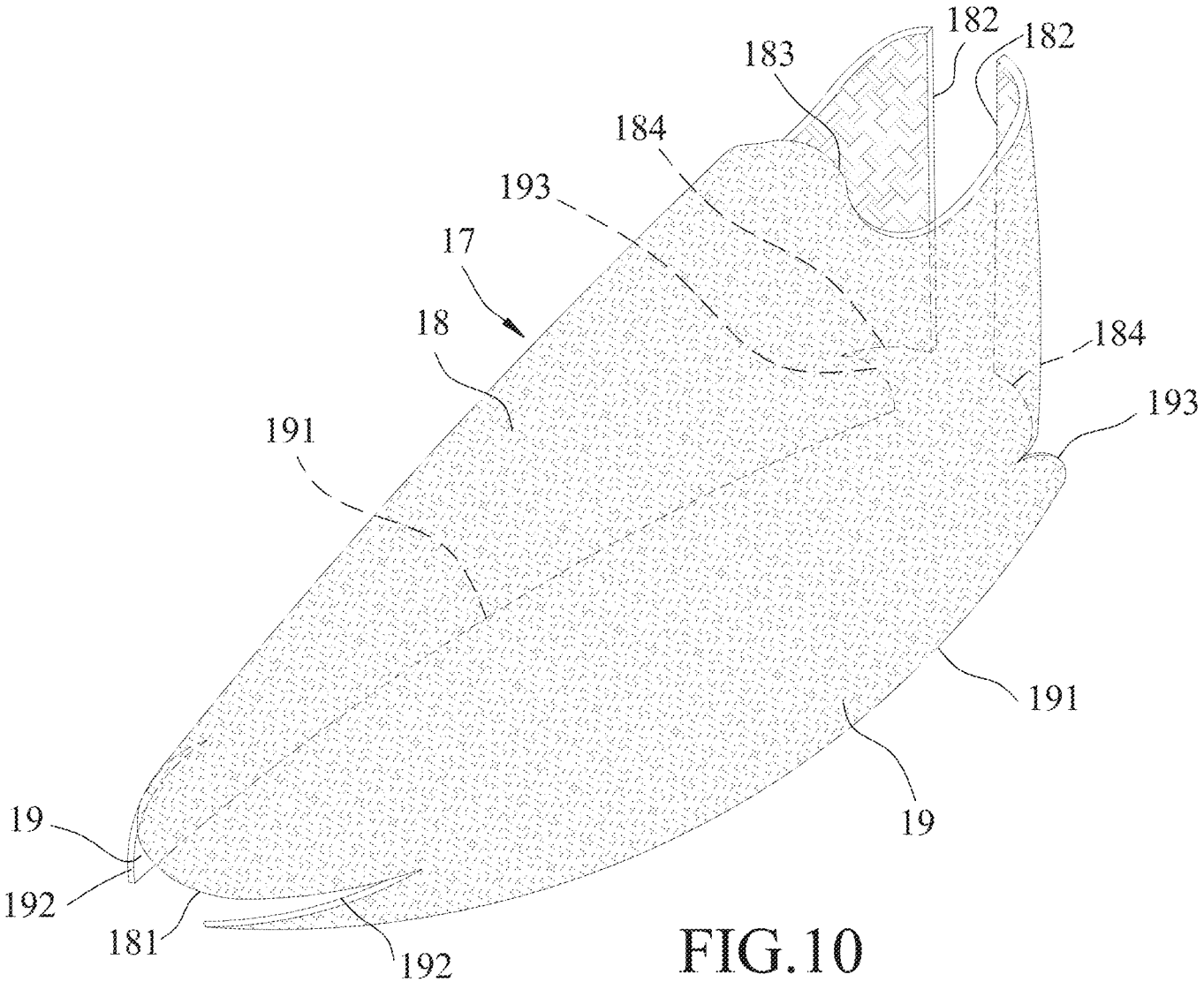
FIG. 10 illustrates how the upper cut piece is folded to form an upper unit.
Figure 11:
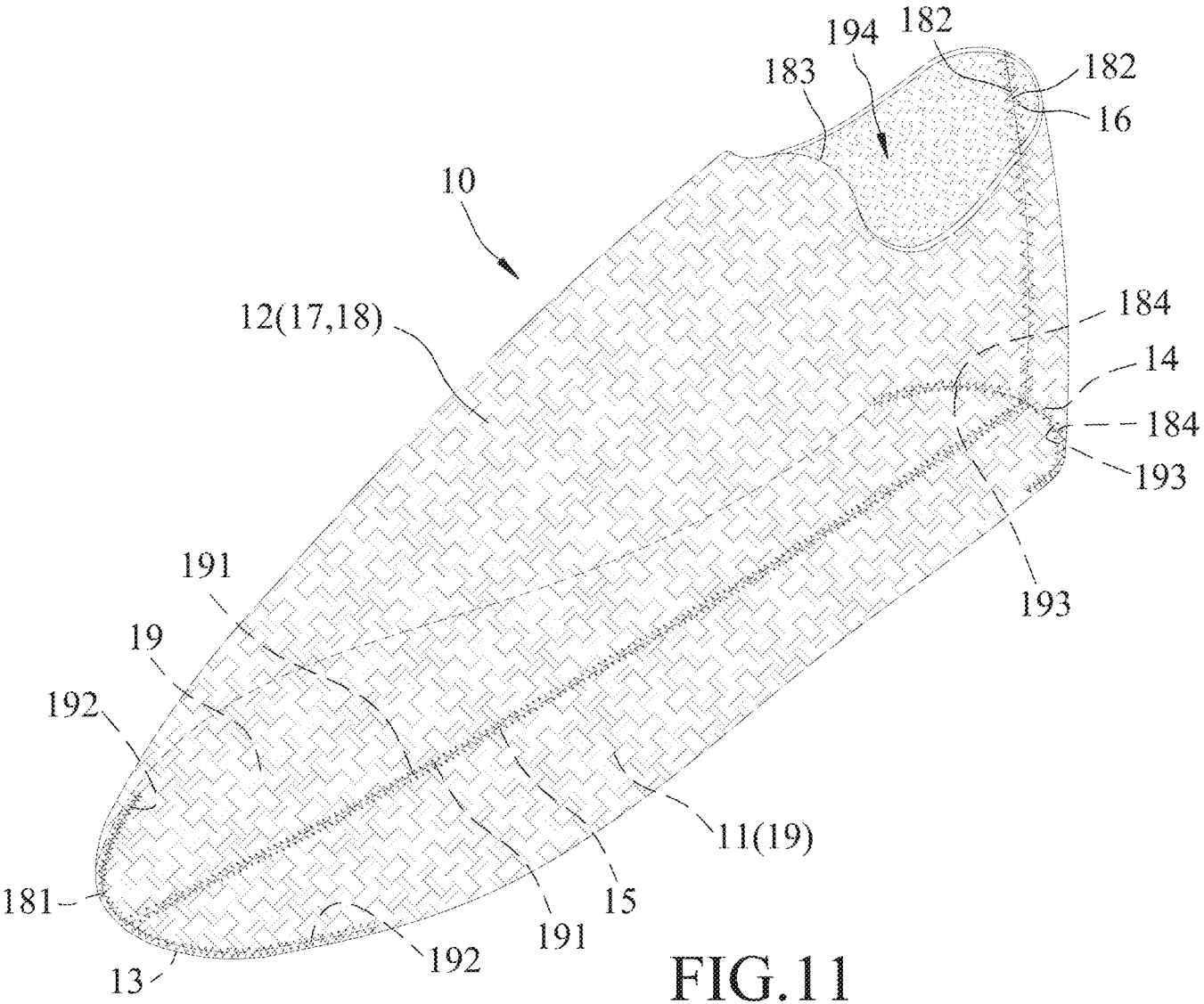
FIG. 11 illustrates how the cut piece is sewn to form the upper unit.
Figure 12:
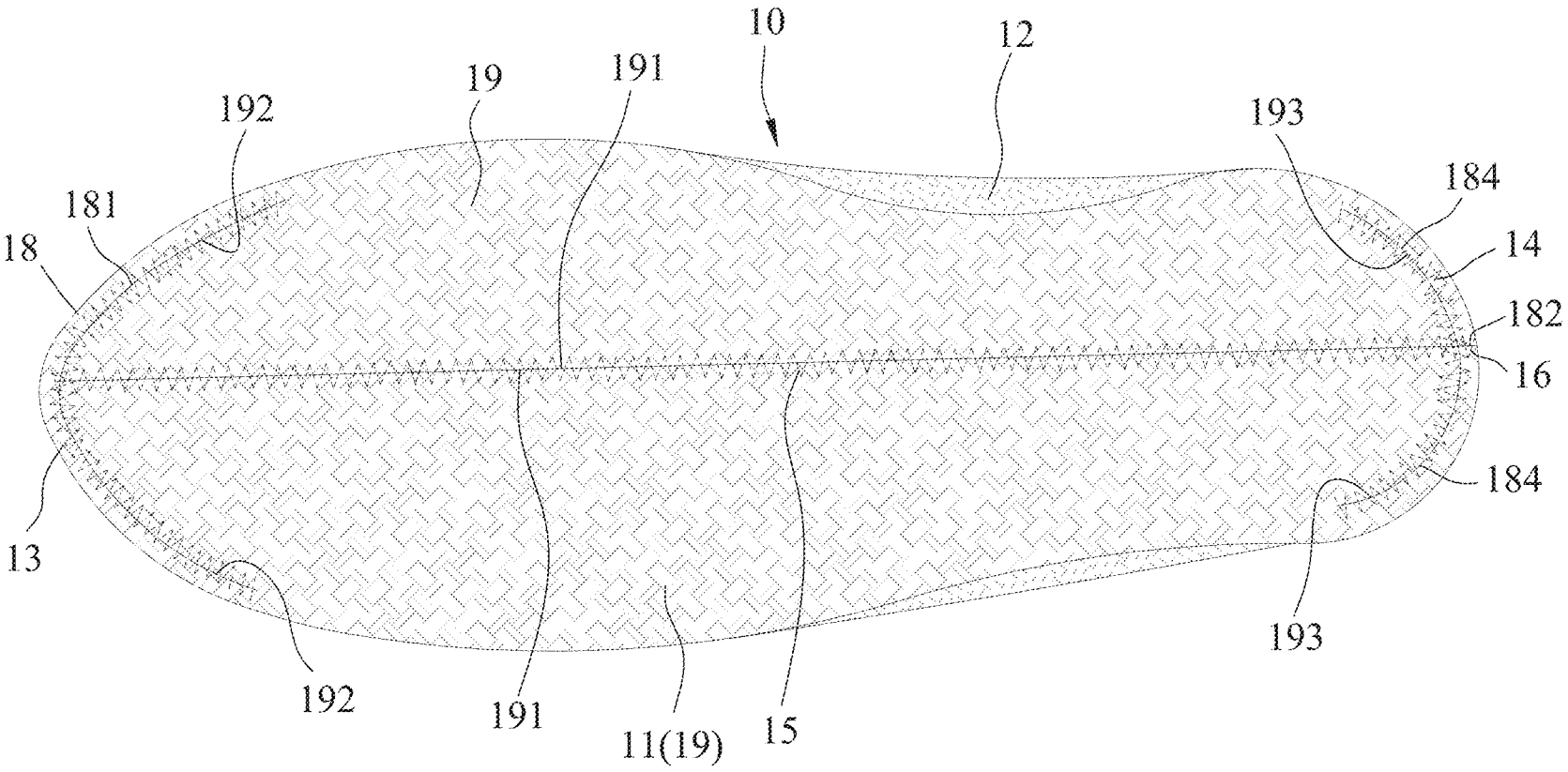
FIG. 12 is a bottom view of the upper unit.

Step 730: fixedly connecting a plurality of waterproof strips 221 to an outer surface of the moisture-permeable waterproof layer 234 so as to cover the seams of the shoe-shaped inner sleeve 21, thereby forming a shoe-shaped inner sleeve unit 20, as shown in FIG. 8.

Step 740: sewing an upper cut piece 17 into an upper unit 10, as shown in FIGS. 9 to 12. In this embodiment, the upper cut piece 17 is made of knitted fabric, and has a main body 18, and two wing portions 19 symmetrically disposed on two opposite sides of the main body 18 and integrally connected as one piece with the main body 18. The main body 18 has a main body front convex edge 181, two symmetrical main body rear end mating edges 182, a main body rear concave edge 183 between the main body rear end mating edges 182 and opposite to the main body front convex edge 181, and two symmetrical main body rear lateral mating edges 184 each of which is connected to one end of a respective one of the main body rear end mating edges 182 that is distal to the main body rear concave edge 183. Specifically, each main body rear end mating edge 182 is located between the main body rear concave edge 183 and a corresponding one of the main body rear lateral mating edges 184. Each of the main body front convex edge 181 and the main body rear concave edge 183 has two opposite ends.

Each wing portion 19 has a wing lateral mating edge 191 spaced apart from the main body 18 and having a front end and a rear end, a wing front curved edge 192 connected between the front end of the wing lateral mating edge 191 and a corresponding one of the opposite ends of the main body front convex edge 181, and a wing rear curved edge 193 connected between the rear end of the wing lateral mating edge 191 and a corresponding one of the main body rear lateral mating edges 184.

In this embodiment, the main body rear end mating edges 182 are abuttingly connected to each other by sewing, the wing lateral mating edges 191 of the wing portions 19 are abuttingly connected to each other by sewing, the wing front curved edges 192 of the wing portions 19 are abuttingly connected to the main body front convex edge 181 by sewing, and the wing rear curved edges 193 of the wing portions 19 are respectively and abuttingly connected to the main body rear lateral mating edges 184 by sewing, thereby forming the upper unit 10.

The upper unit 10 defines an interior space 194 having a top open end, and includes a bottom surface 11 (see FIG. 12), and a peripheral surface 12 connected to a periphery of the bottom surface 11 and cooperating with the same to define the interior space 194. Further, the upper unit 10 has a toe stitching portion 13, a heel stitching portion 14, a bottom stitching portion 15, and a rear end stitching portion 16. The toe stitching portion 13, the heel stitching portion 14 and the bottom stitching portion 15 are located on the bottom surface 11 of the upper unit 10, while the rear end stitching portion 16 is located on a rear end of the peripheral surface 12 of the upper unit 10. The toe stitching portion 13 extends along a junction of the main body front convex edge 181 and the wing front curved edges 192. The heel stitching portion 14 extends along a junction of the main body rear lateral mating edges 184 and the wing rear curved edges 193. The bottom stitching portion 15 extends along a junction of the wing lateral mating edges 191. The rear end stitching portion 16 extends along a junction of the main body rear end mating edges 182. In this embodiment, each of the toe stitching portion 13, the heel stitching portion 14, the bottom stitching portion 15 and the rear end stitching portion 16 is formed by a single stitch, but is not limited thereto.

Figure 13:
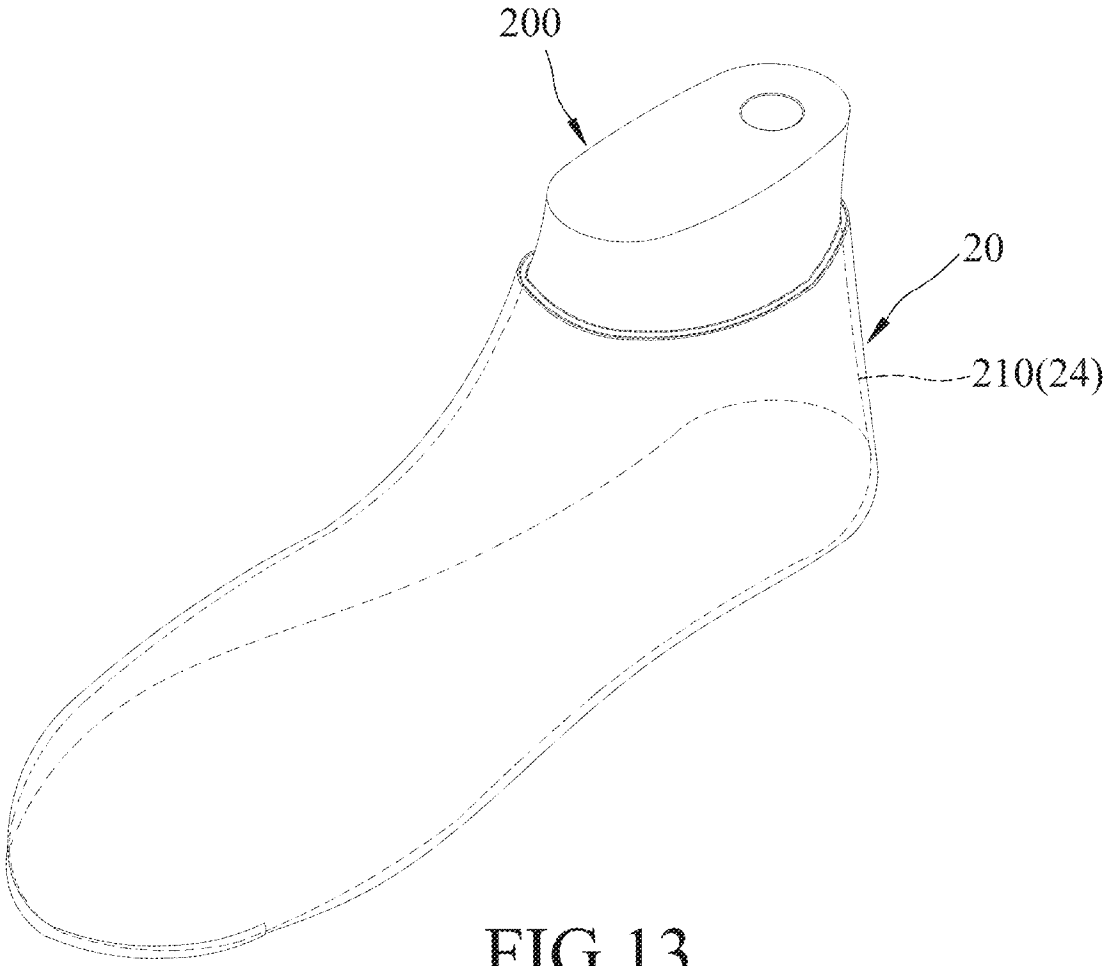
FIG. 13 is a perspective view of an assembly of the shoe-shaped inner sleeve unit and a last.

Step 750: sleeving the shoe-shaped inner sleeve unit 20, which is moisture-permeable and waterproof, on a forming portion 210 of a last 200 such that the forming portion 210 of the last 200 is inserted into the foot space 24 (see FIG. 8) through the top open end thereof, as shown in FIG. 13. The forming portion 210 has a forming volume. In this embodiment, the foot space 24 has a volume smaller than the forming volume of the forming portion 210 by 5 to 10%. At this time, the forming portion 210 will temporarily expand the shoe-shaped inner sleeve unit 20.

Figure 14:
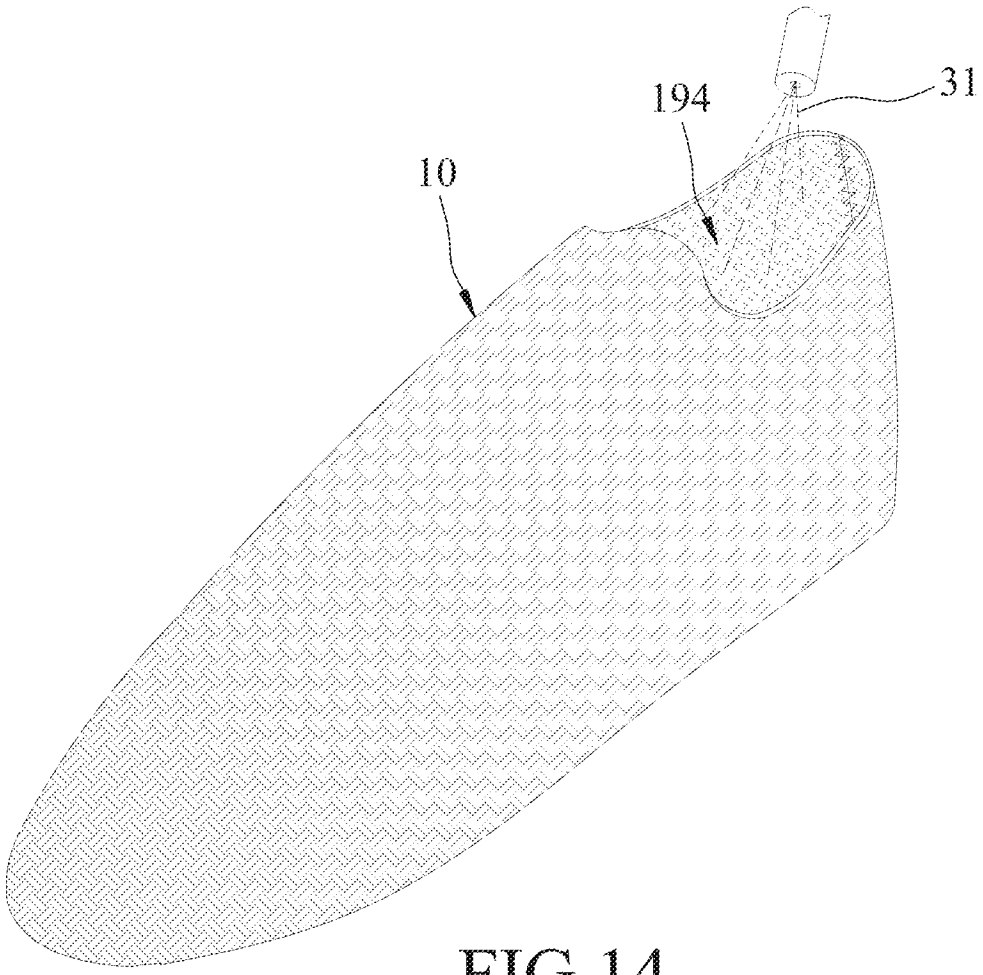
FIG. 14 illustrates an inner surface of the upper unit being sprayed with adhesive.

Step 760: coating a bonding agent 31 on an inner surface of the upper unit 10. In this embodiment, the bonding agent 31 is hot melt adhesive sprayed on the inner surface of the upper unit 10, as shown in FIG. 14.

Figure 15:
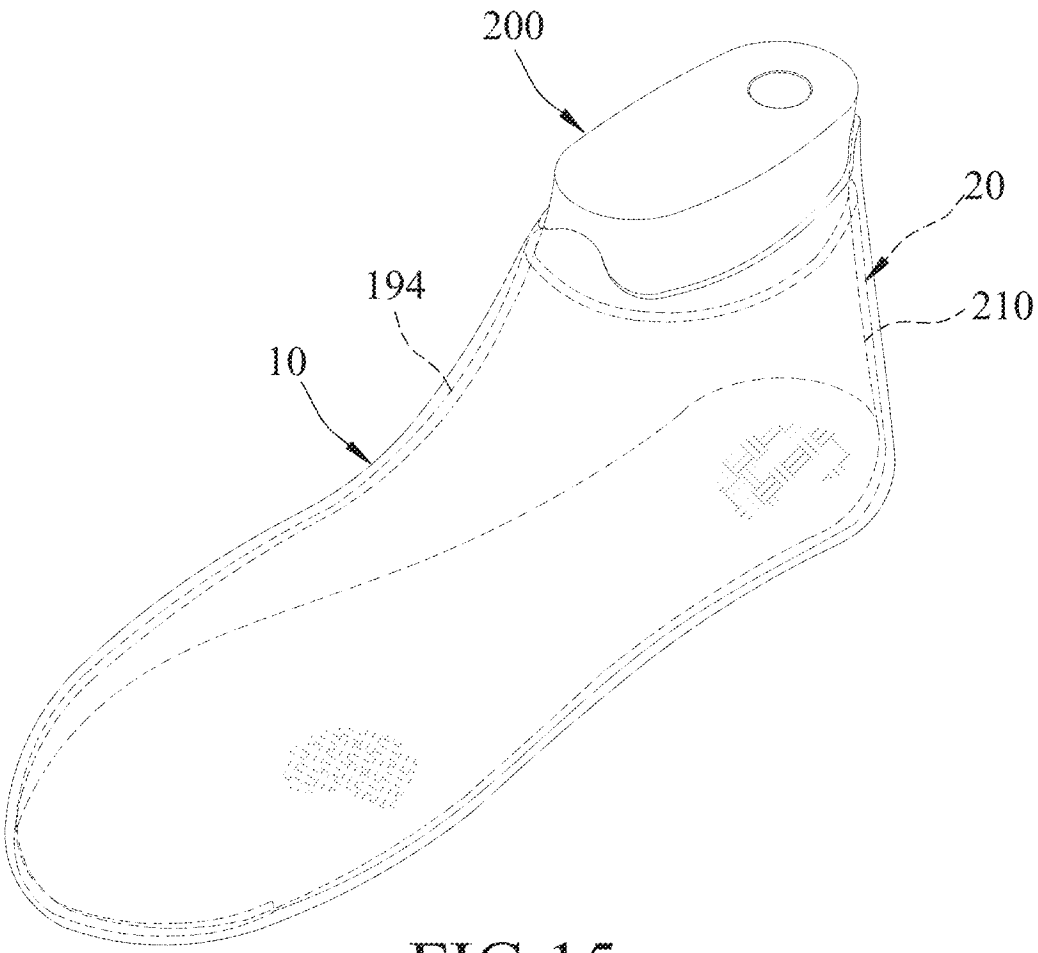
FIG. 15 is a view similar to FIG. 13, but with the upper unit being sleeved on the assembly of the shoe-shaped inner sleeve unit and the last.

Step 770: sleeving the upper unit 10 on an assembly of the shoe-shaped inner sleeve unit 20 and the last 200 (see FIG. 13) such that the assembly of the shoe-shaped inner sleeve unit 20 and the last 200 is inserted into the interior space 194 of the upper unit 10 through the top open end thereof, as shown in FIG. 15. In this embodiment, the interior space 194 has a volume smaller than the forming volume of the forming portion 210 by 5 to 10%. At this time, the forming portion 210 will also temporarily expand the upper unit 10.

Figure 16:
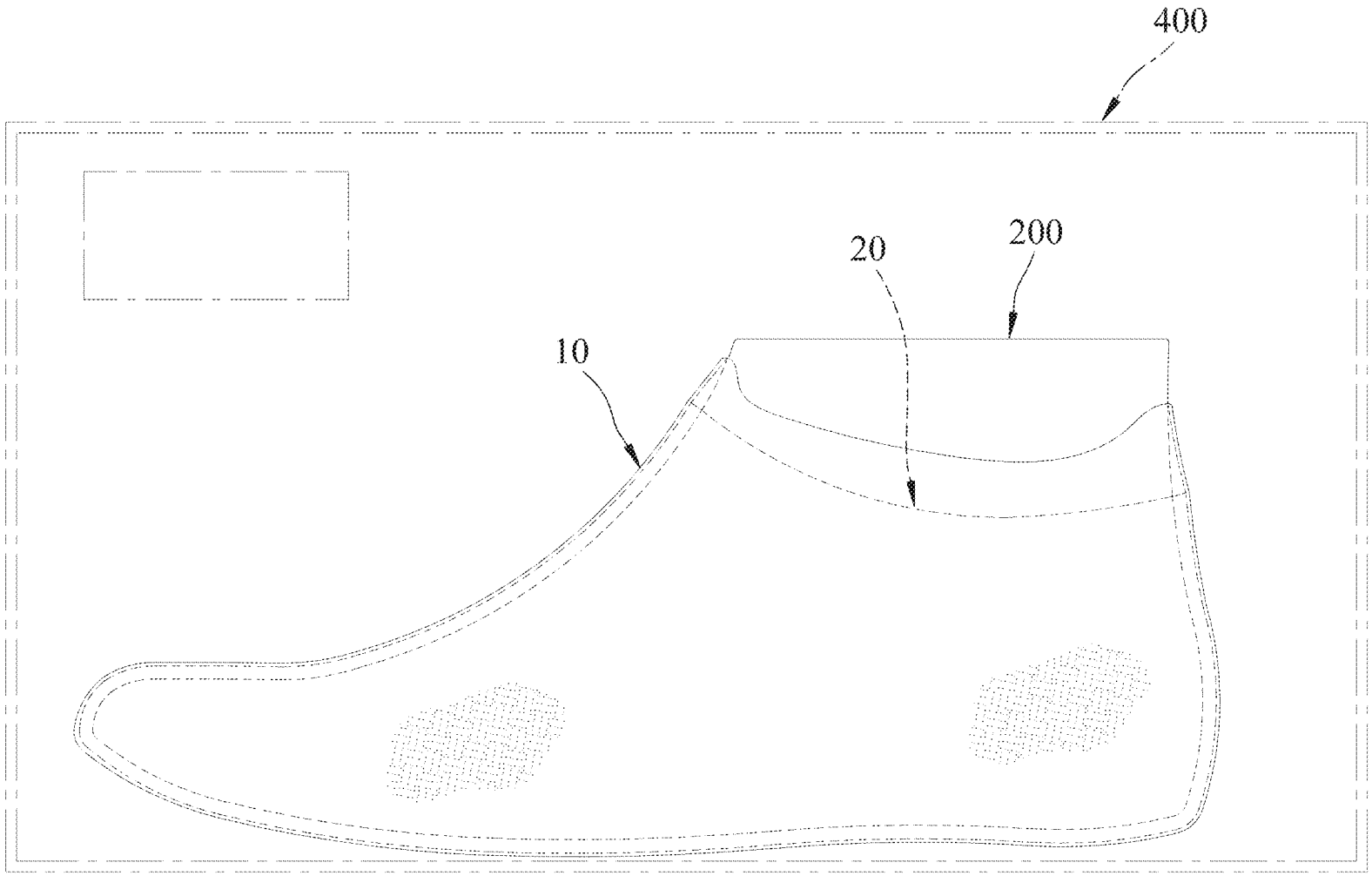
FIG. 16 illustrates an assembly of the upper unit, the shoe-shaped inner sleeve unit and the last being placed in a heating device.
Figure 24:
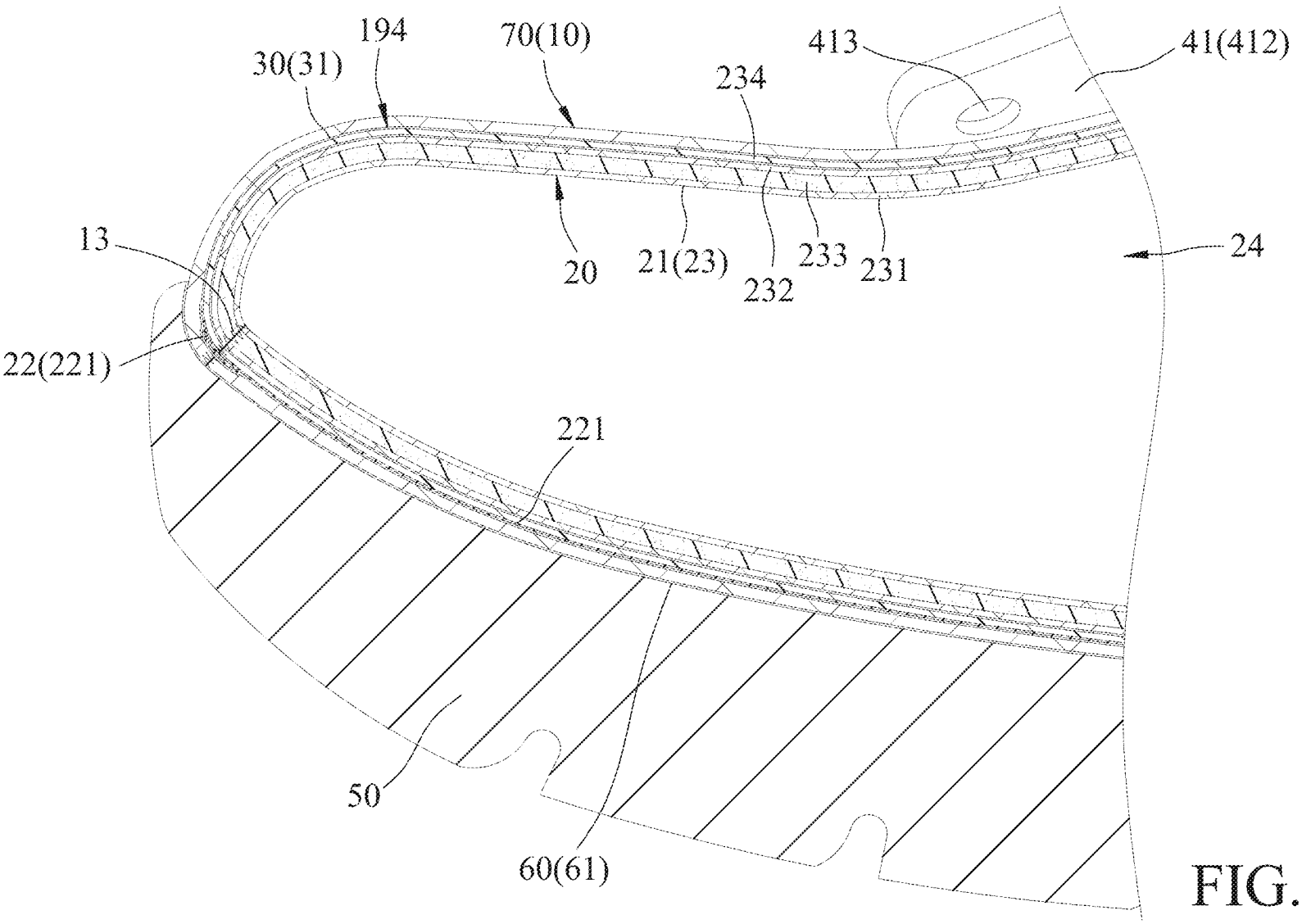
FIG. 24 is an enlarged fragmentary view of FIG. 23.

Step 780: placing an assembly of the upper unit 10, the shoe-shaped inner sleeve unit 20 and the last 200 in a heating device 400, as shown in FIG. 16, to heat the same to a predetermined heating temperature and a predetermined heating time. In this way, the bonding agent 31 between the upper unit 10 and the shoe-shaped inner sleeve unit 20 will be cured by heating and will be formed into a first adhesive layer 30 (see FIG. 24) between the inner surface of the upper unit 10 and an outer surface of the shoe-shaped inner sleeve unit 20, thereby fixing together the upper unit 10 and the shoe-shaped inner sleeve unit 20.

In this embodiment, the heating device 400 is an oven, the predetermined heating temperature is between 50° C. to 150° C., and the predetermined heating time is not less than 10 minutes.

Figure 17:
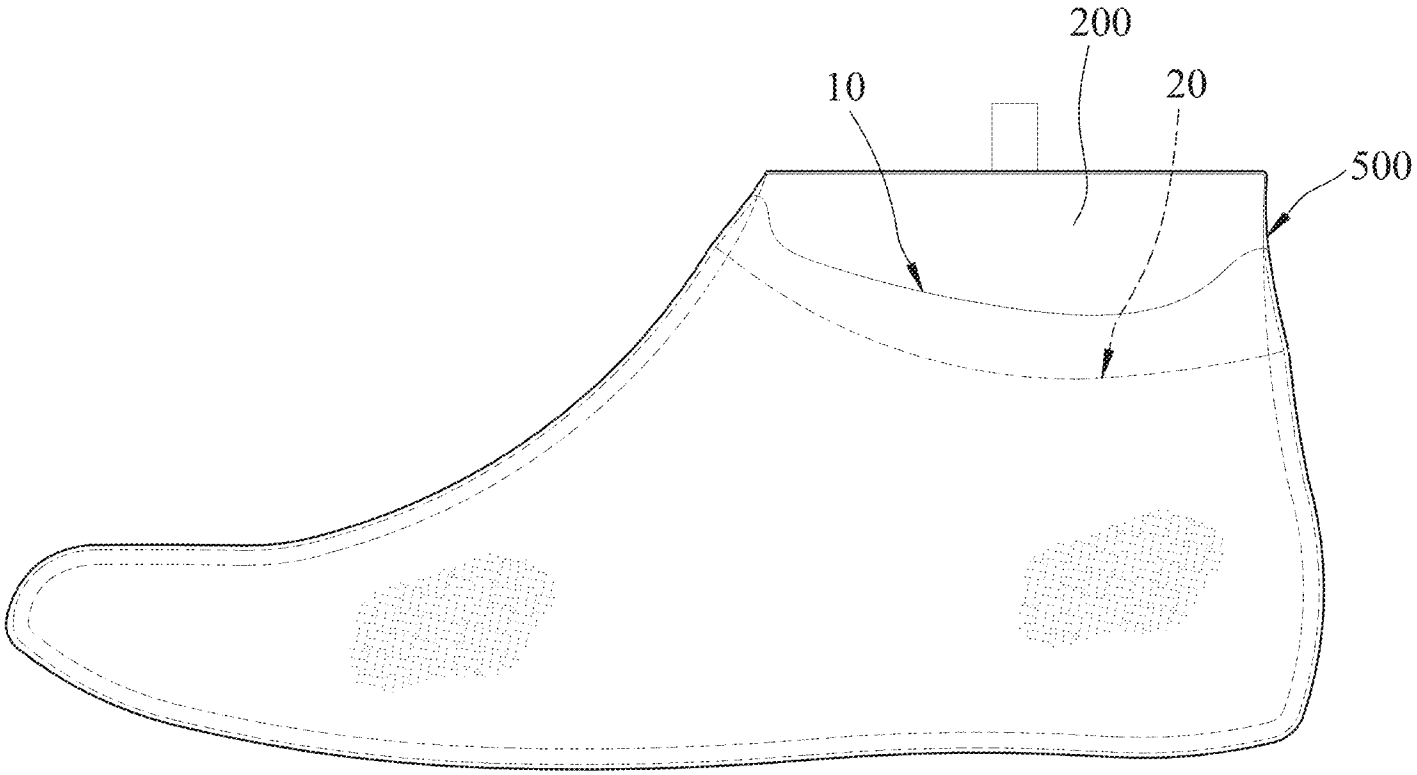
FIG. 17 illustrates the assembly of the upper unit, the shoe-shaped inner sleeve unit and the last being placed in a vacuum bag.

Step 790: removing the assembly of the upper unit 10, the shoe-shaped inner sleeve unit 20 and the last 200 from the heating device 400, and then placing the same in a vacuum bag 500, as shown in FIG. 17, after which air is evacuated from the vacuum bag 500 for a predetermined vacuum time. In this embodiment, the predetermined vacuum time is between 20 to 60 seconds.

Figure 18:
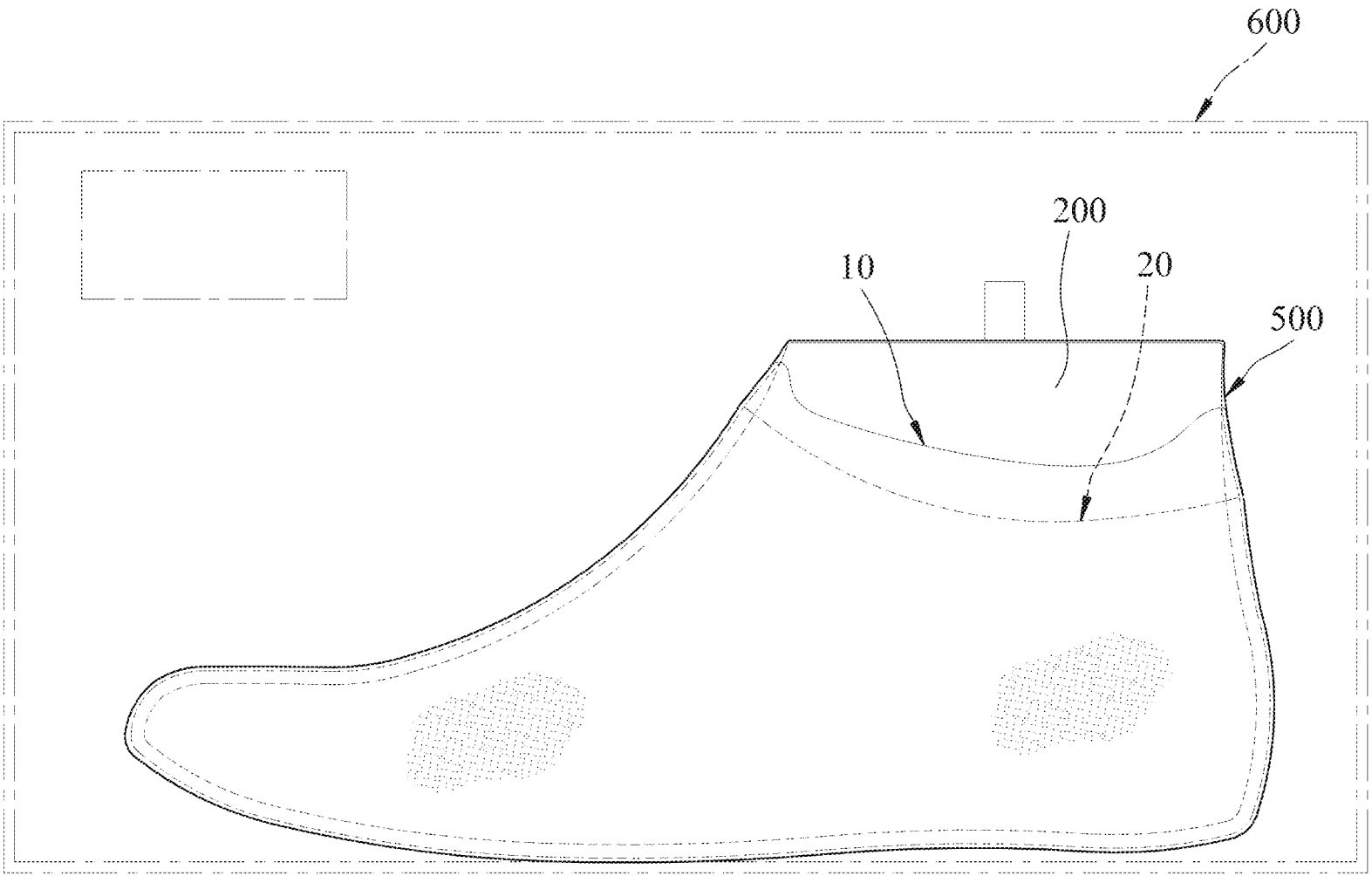
FIG. 18 illustrates the vacuum bag containing the assembly of the upper unit, the shoe-shaped inner sleeve unit and the last being placed in a freezing device.

Step 800: placing the vacuum bag 500, which contains the assembly of the upper unit 10, the shoe-shaped inner sleeve unit 20 and the last 200, in a freezing device 600, as shown in FIG. 18, and freezing the same to a predetermined freezing temperature and a predetermined freezing time. In this embodiment, the freezing device 600 is a freezer, the predetermined freezing temperature is between −5° C. to 5° C., and the predetermined freezing time is not less than 2 hours.

Figure 19:
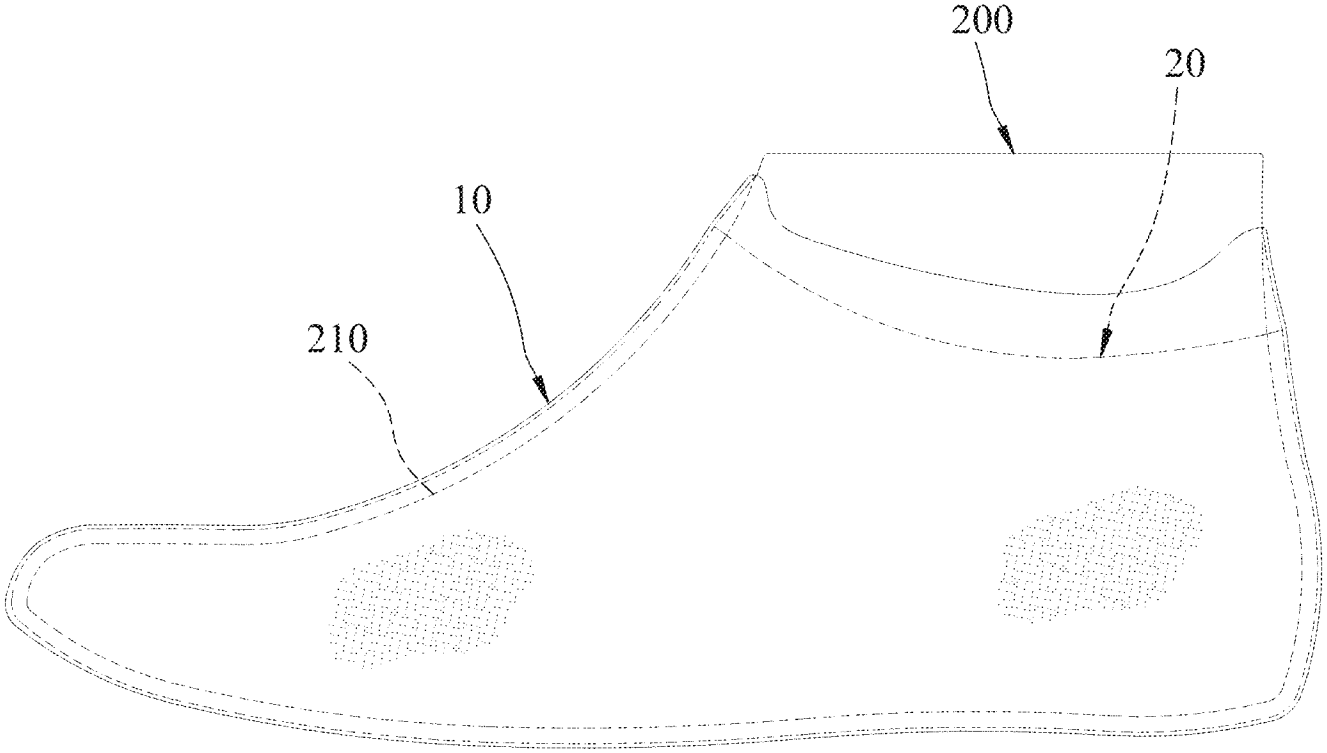
FIG. 19 illustrates the assembly of the upper unit, the shoe-shaped inner sleeve unit and the last after being removed from the vacuum bag.

Step 810: removing the vacuum bag 500 containing the assembly of the upper unit 10, the shoe-shaped inner sleeve unit 20 and the last 200 from the freezing device 600, and then removing the assembly of the upper unit 10, the shoe-shaped inner sleeve unit 20 and the last 200 from the vacuum bag 500 by breaking the vacuum bag 500, as shown in FIG. 19.

Figure 20:
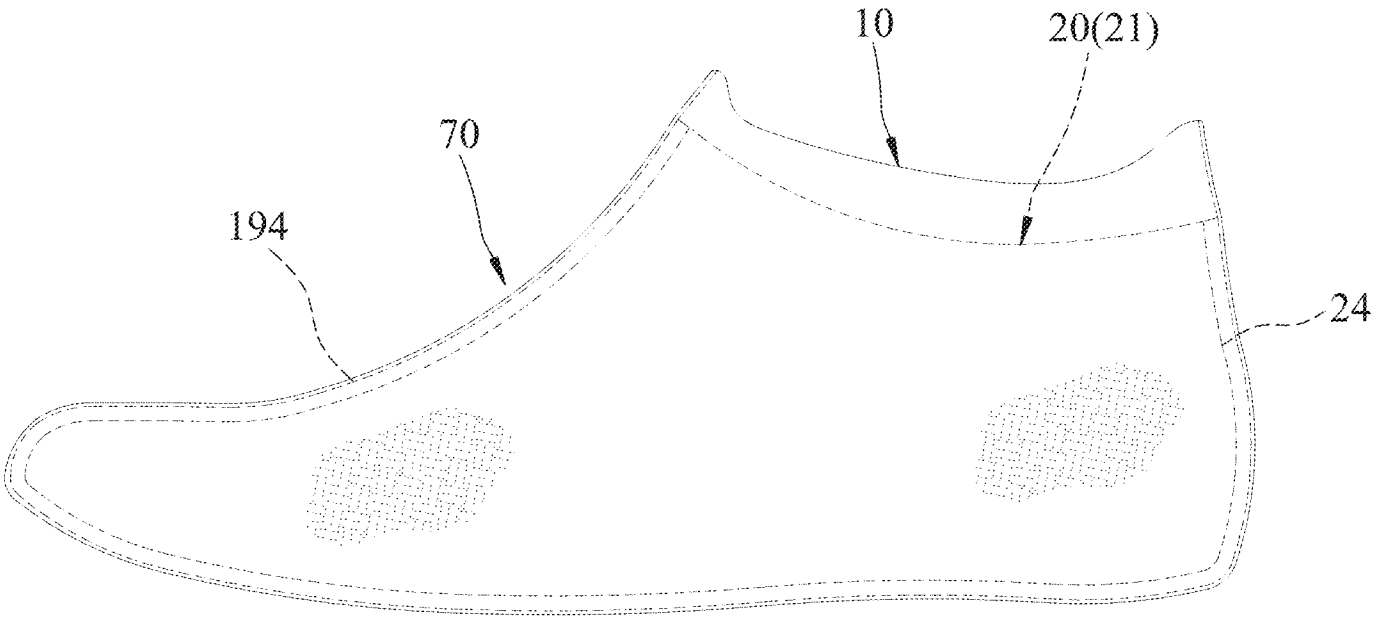
FIG. 20 illustrates the shoe-shaped inner sleeve unit and the upper unit forming a three-dimensional moisture-permeable waterproof upper structure after the last is pulled out from the shoe-shaped inner sleeve unit.

Step 820: pulling out the last 200 from the shoe-shaped inner sleeve unit 20. At this time, the upper unit 10 and the shoe-shaped inner sleeve unit 20 form a three-dimensional (3D) moisture-permeable waterproof upper structure 70, as shown in FIG. 20. In this step, since each of the interior space 194 of the upper unit 10 and the foot space 24 of the shoe-shaped inner sleeve 21 has a volume smaller than the forming volume of the forming portion 210 of the last 200 by 5 to 10%, after the last 200 is pulled out, each of the upper unit 10 and the shoe-shaped inner sleeve unit 20 will elastically shrink back to its original volume. As such, the 3D moisture-permeable waterproof upper structure 70 can provide a good covering effect for a foot of a user.

Figure 21:
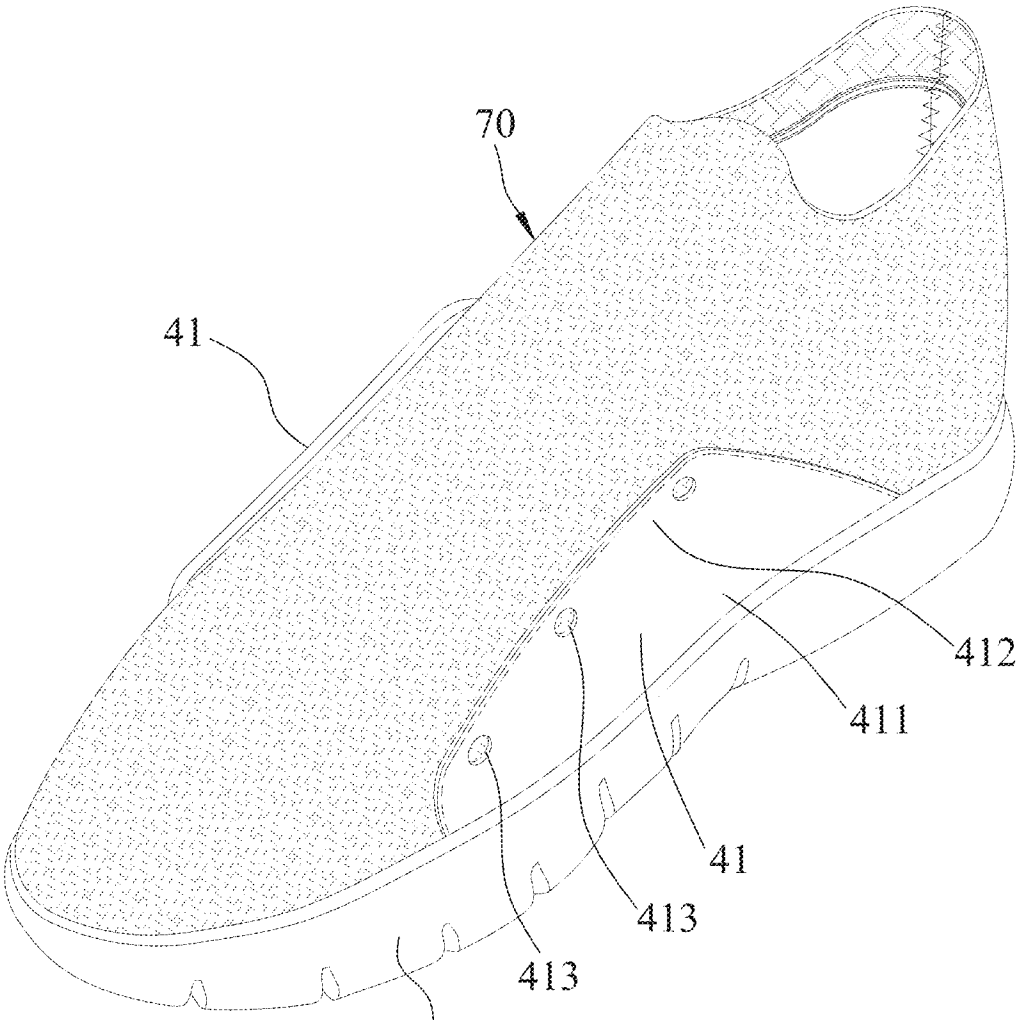
FIG. 21 illustrates two decorative tightening plates being fixedly disposed on left and right sides of a sole, after which the sole is fixedly connected to a bottom portion of the three-dimensional moisture-permeable waterproof upper structure.

Step 830: fixing two decorative tightening plates 41 to left and right sides of a sole 50, as shown in FIG. 21. In this embodiment, each decorative tightening plate 41 has a bottom end portion 411 connected to the sole 50, and a top end portion 412 formed with a plurality of spaced-apart through holes 413.

Figure 22:
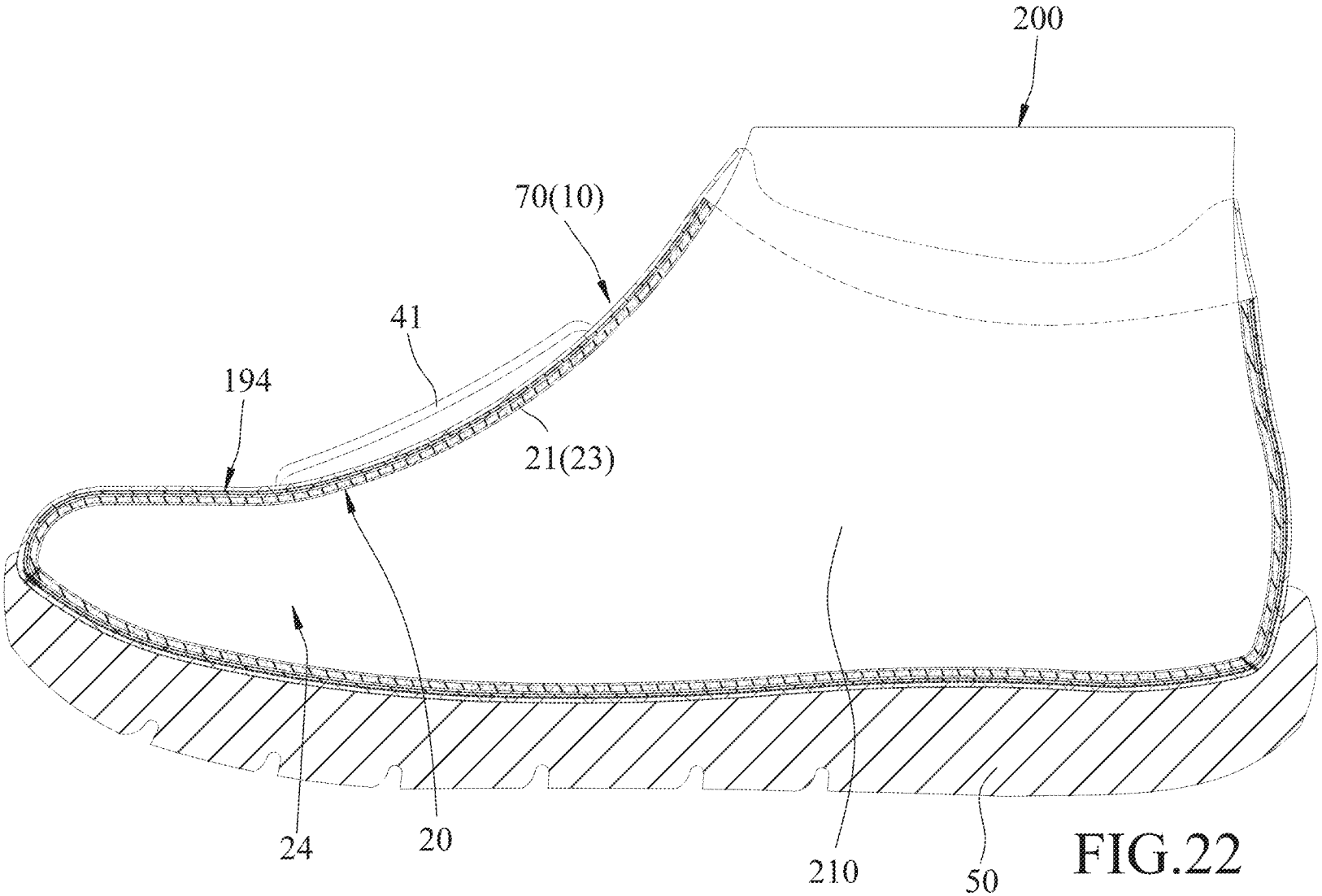
FIG. 22 is a sectional view of an assembly of three-dimensional moisture-permeable waterproof upper structure and the last.

Step 840: sleeving the 3D waterproof moisture-permeable upper structure 70 on the last 200, as shown in FIG. 22.

Step 850: fixing the sole 50 to a bottom portion of the 3D moisture-permeable waterproof upper structure 70 such that the decorative tightening plates 41 are located on left and right sides of the 3D moisture-permeable waterproof upper structure 70, as shown in FIGS. 21 and 22.

In this embodiment, an adhesive agent 61 (see FIG. 24) is used to fix together a top portion of the sole 50 and the bottom portion of the 3D moisture-permeable waterproof upper structure 70. After the adhesive agent 61 is solidified, a second adhesive layer 60 (see FIG. 24) is formed between the top portion of the sole 50 and the bottom portion of the 3D moisture-permeable waterproof upper structure 70.

Figure 23:
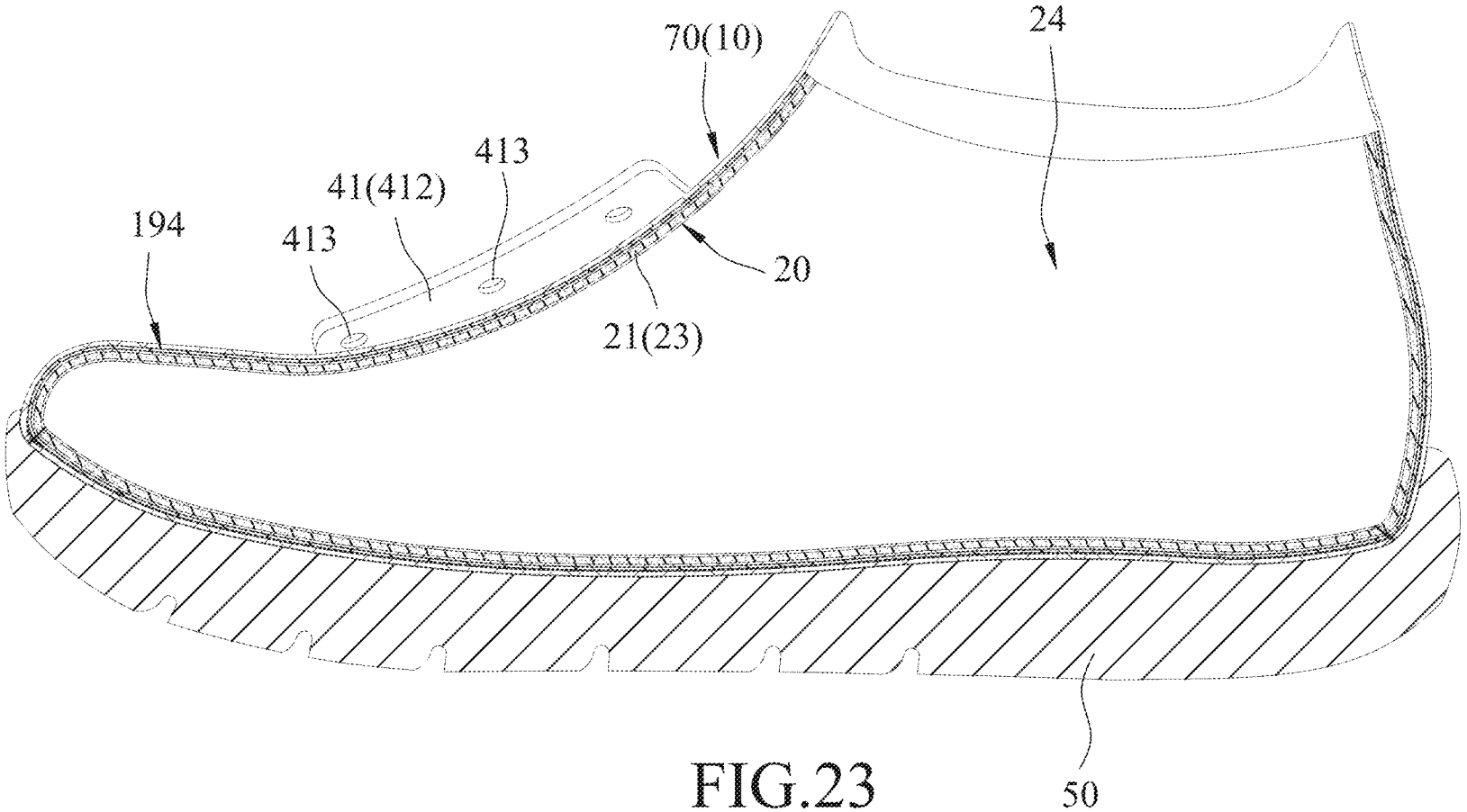
FIG. 23 is a view similar to FIG. 22, but with the last being pulled out from the three-dimensional moisture-permeable waterproof upper structure.

Step 860: pulling out the last 200 from the 3D moisture-permeable waterproof upper structure 70, as shown in FIG. 23.

Figure 25:
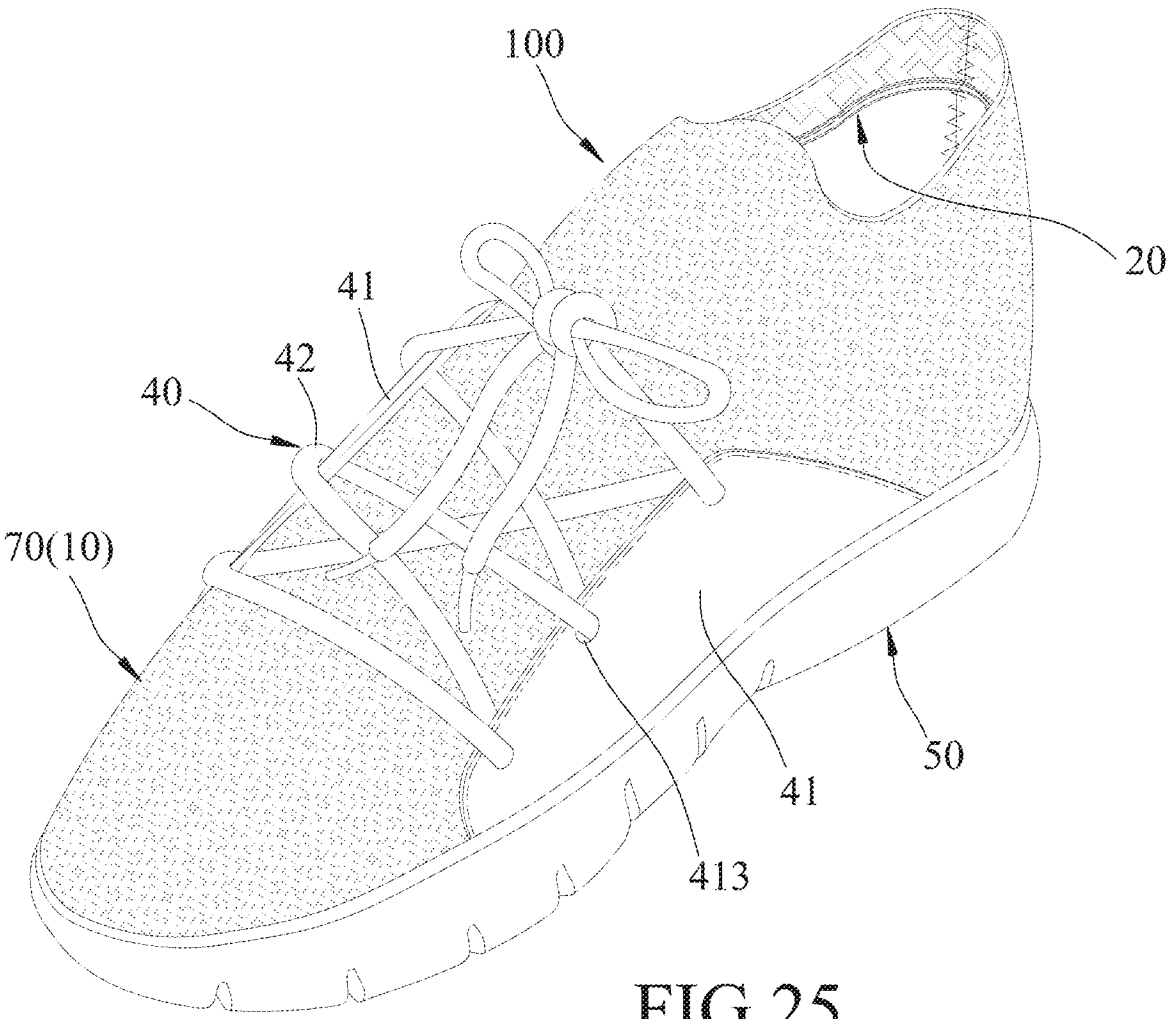
FIG. 25 is a perspective view of the moisture-permeable waterproof shoe made from the method of this embodiment.

Step 870: removably threading a tightening strap 42 through the through holes 413 in the decorative tightening plates 41 to interconnect the same, as shown in FIG. 25. In this embodiment, the decorative tightening plates 41 and the tightening strap 42 can be defined as a tightening unit 40.

Figure 26:
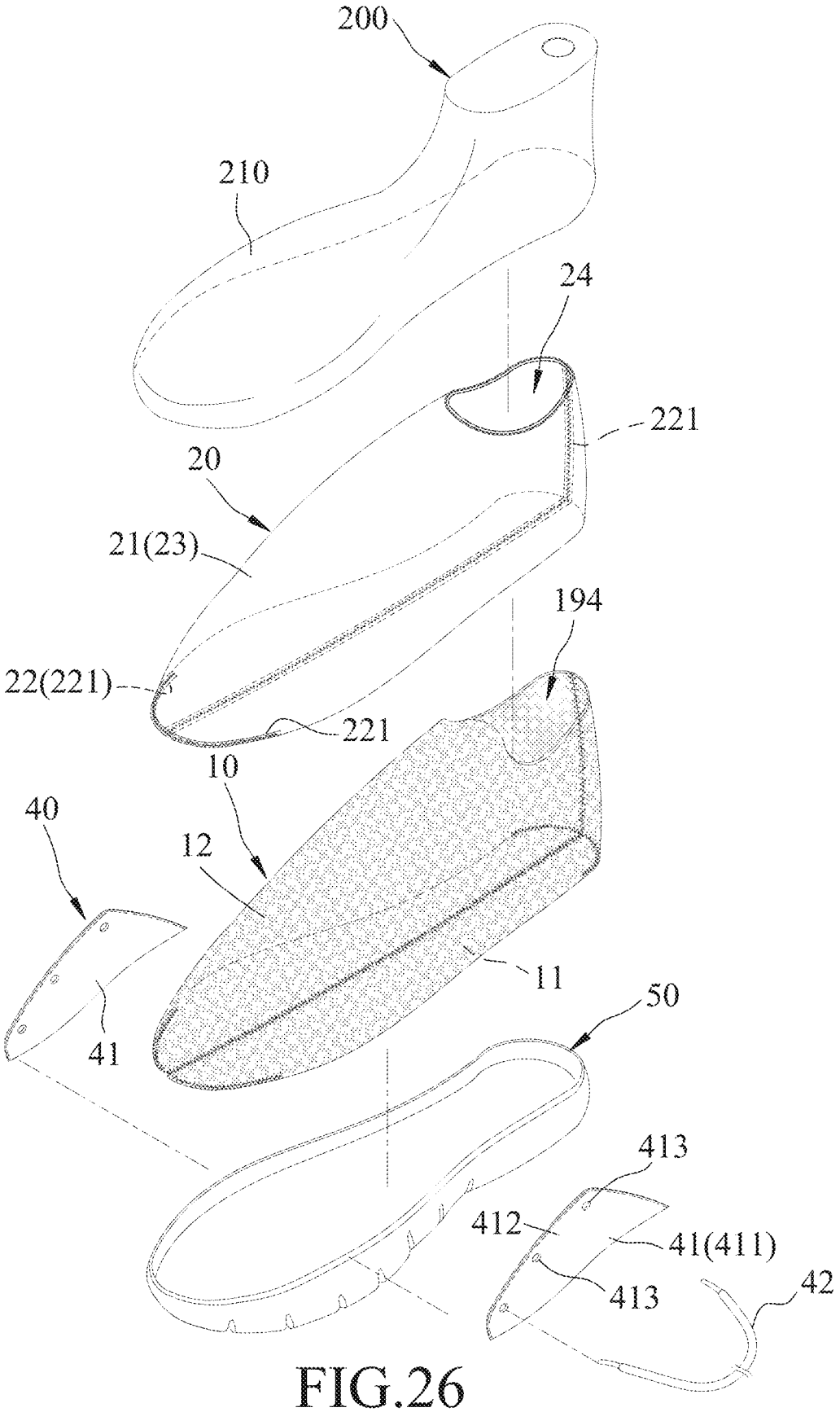
FIG. 26 is an exploded perspective view of the moisture-permeable waterproof shoe of FIG. 25 and the last.

Thus, the making of the moisture-permeable waterproof shoe 100 is completed, as shown in FIGS. 25 and 26.

Figure 1:
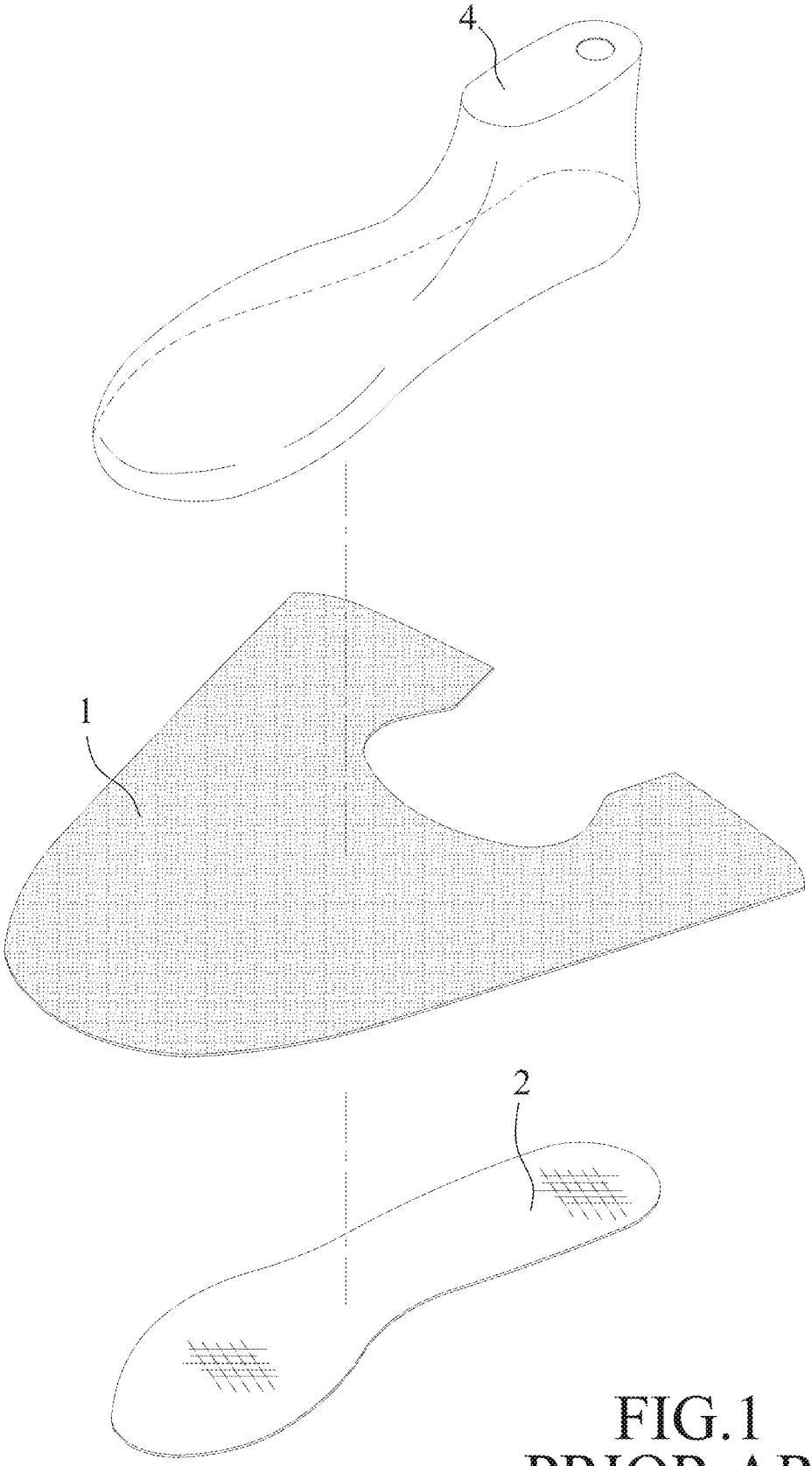
FIG.1 PRIOR ART
FIG. 1 is an exploded perspective view of an upper and a midsole cardboard of a conventional shoe and a last.
Figure 2:
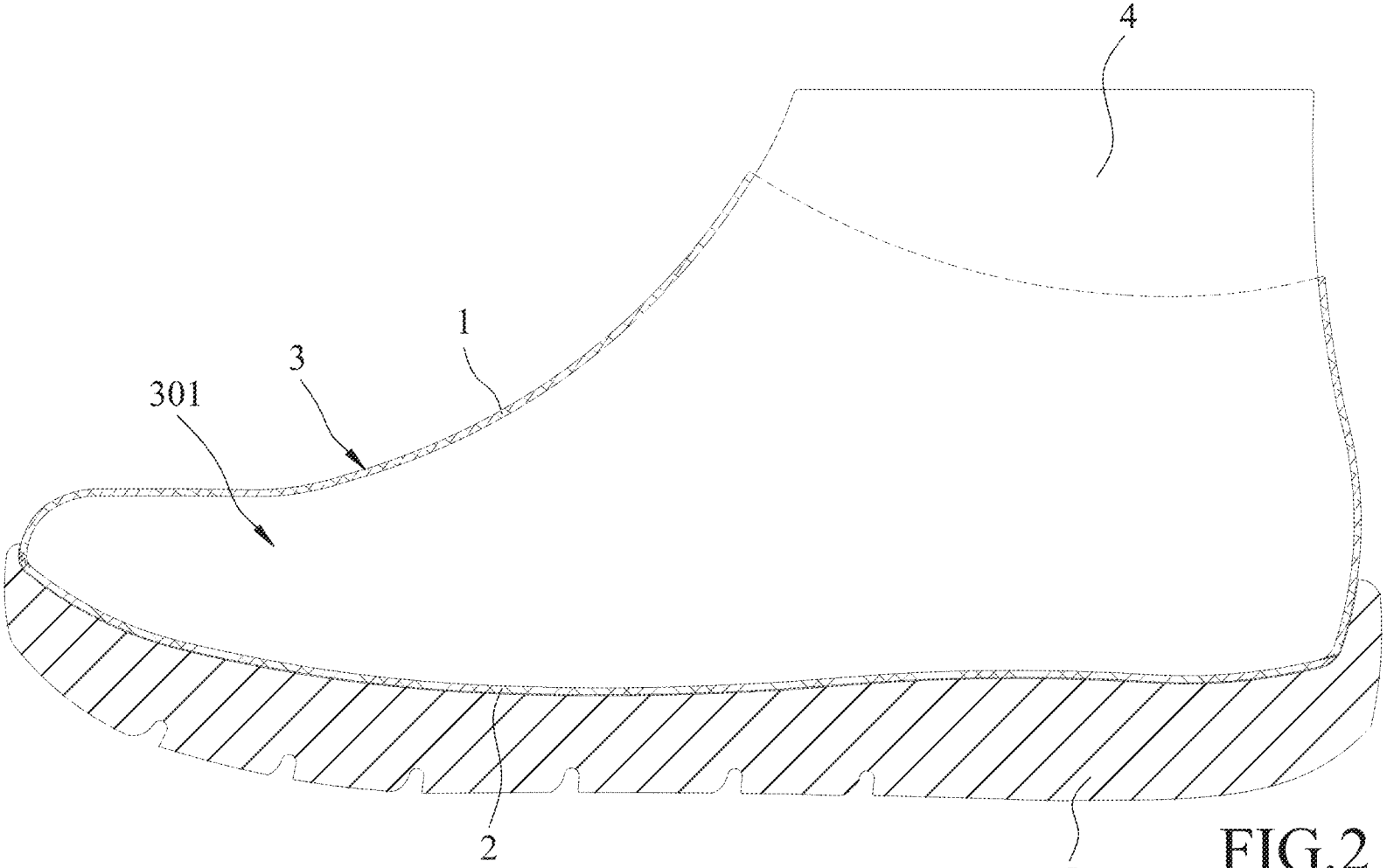
FIG.2 PRIOR ART
FIG. 2 is an assembled sectional view of FIG. 1.

From the foregoing, the advantages of this disclosure can be summarized as follows:

1) The upper cut piece 17 is sewn to directly form the 3D upper unit 10. In comparison with the prior art, the upper unit 10 of the moisture-permeable waterproof shoe 100 of this disclosure does not need to be sewn with the midsole cardboard 2 (see FIGS. 1 and 2) of the prior art, so that it is more labor-saving. Further, the number of components of this disclosure is minimized, so that the manufacturing cost thereof is reduced.

2) In comparison with the prior art, each of the interior space 194 of the upper unit 10 and the foot space 24 of the shoe-shaped inner sleeve 21 of this disclosure has a volume smaller than the forming volume of the forming portion 210 of the last 200 by 5 to 10%, so that, after the last 200 is pulled out from the 3D moisture-permeable waterproof upper structure 70, the 3D moisture-permeable waterproof upper structure 70 will elastically shrink back to its original volume. As such, for users whose foot size corresponds to the size of the last 200, the moisture-permeable waterproof shoe 100 of this disclosure can provide a good covering effect, as well as comfort during wear thereof.

3) In comparison with the prior art, a bottom structure of the upper unit 10 and a bottom structure of the shoe-shaped inner sleeve unit 20 are stacked under the foot of the user, and have a total thickness that can provide good elasticity and comfort feeling during wear of the moisture-permeable waterproof shoe 100 of this disclosure.

In summary, the moisture-permeable waterproof shoe 100 of this disclosure has an integrally formed upper unit 10, so that making of the moisture-permeable waterproof shoe 100 is labor saving, thereby reducing the manufacturing cost thereof. Further, the moisture-permeable waterproof shoe 100 has good covering and elasticity effect during wear thereof, and is also comfortable to wear. Therefore, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A method for making a moisture-permeable waterproof shoe comprising:

(A1) adhering a moisture-permeable waterproof membrane to a three-layer fabric to form an inner sleeve base material, the three-layer fabric including a fabric lining layer, an outer fabric layer, and a foam layer fixed between the fabric lining layer and the outer fabric layer, the moisture-permeable waterproof membrane being adhered to an outer surface of the outer fabric layer;

(A2) cutting the inner sleeve base material into an inner sleeve cut piece, the inner sleeve cut piece including a fabric lining layer, an outer fabric layer, a foam layer fixed between the fabric lining layer and the outer fabric layer, and a moisture-permeable waterproof layer fixed to an outer surface of the outer fabric layer;

(A3) sewing the inner sleeve cut piece into a shoe-shaped inner sleeve, the shoe-shaped inner sleeve defining a foot space having a top open end;

(A4) fixedly connecting a plurality of waterproof strips to an outer surface of the moisture-permeable waterproof layer so as to cover the seams of the shoe-shaped inner sleeve, thereby forming a shoe-shaped inner sleeve unit;

(A5) sewing an upper cut piece into an upper unit, the upper cut piece being made of knitted fabric and having a main body, and two wing portions symmetrically disposed on two opposite sides of the main body and integrally connected as one piece with the main body, the main body having a main body front convex edge, two symmetrical main body rear end mating edges, a main body rear concave edge between the main body rear end mating edges and opposite to the main body front convex edge, and two symmetrical main body rear lateral mating edges respectively connected to the main body rear end mating edges, each of the wing portions having a wing lateral mating edge spaced apart from the main body and having a front end and a rear end, a wing front curved edge connected between the front end of the wing lateral mating edge and a corresponding one of the opposite ends of the main body front convex edge, and a wing rear curved edge connected between the rear end of the wing lateral mating edge and a corresponding one of the main body rear lateral mating edges;

wherein, the main body rear end mating edges are abuttingly connected to each other by sewing, the wing lateral mating edges of the wing portions are abuttingly connected to each other by sewing, the wing front curved edges of the wing portions are abuttingly connected to the main body front convex edge by sewing, and the wing rear curved edges of the wing portions are respectively and abuttingly connected to the main body rear lateral mating edges by sewing, thereby forming the upper unit;

wherein the upper unit includes a bottom surface, and a peripheral surface connected to a periphery of said bottom surface and cooperating with the bottom surface to define an interior space having a top open end, the upper unit having a toe stitching portion extending along a junction of the main body front convex edge and the wing front curved edges, and a heel stitching portion extending along a junction of the main body rear lateral mating edges and the wing rear curved edges, the toe stitching portion and the heel stitching portion being located on the bottom surface of the upper unit;

(A) sleeving the shoe-shaped inner sleeve unit, which is moisture-permeable and waterproof, on a forming portion of a last such that the forming portion of the last is inserted into the foot space through the top open end thereof, the forming portion having a forming volume, the foot space having a volume smaller than the forming volume of the forming portion by 5 to 10%;

(B) coating a bonding agent on an inner surface of the upper unit;

(C) sleeving the upper unit on an assembly of the shoe-shaped inner sleeve unit and the last such that the assembly of the shoe-shaped inner sleeve unit and the last is inserted into the interior space through the top open end thereof, the interior space having a volume smaller than the forming volume of the forming portion by 5 to 10%;

(D) placing an assembly of the upper unit, the shoe-shaped inner sleeve unit and the last in a heating device to heat the assembly of the upper unit, the shoe-shaped inner sleeve unit and the last to a predetermined heating temperature and a predetermined heating time;

(E) removing the assembly of the upper unit, the shoe-shaped inner sleeve unit and the last from the heating device, and then placing the assembly of the upper unit, the shoe-shaped inner sleeve unit and the last in a vacuum bag, after which air is evacuated from the vacuum bag for a predetermined vacuum time;

(F) placing the vacuum bag, which contains the assembly of the upper unit, the shoe-shaped inner sleeve unit and the last, in a freezing device to freeze the vacuum bag to a predetermined freezing temperature and a predetermined freezing time;

(G) removing the vacuum bag from the freezing device, and then removing the assembly of the upper unit, the shoe-shaped inner sleeve unit and the last from the vacuum bag;

(H) pulling out the last from the shoe-shaped inner sleeve unit, the upper unit and the shoe-shaped inner sleeve unit forming a three-dimensional moisture-permeable waterproof upper structure after the last is pulled out; and (I) fixing a sole to a bottom portion of the three-dimensional moisture-permeable waterproof upper structure.

2. The method as claimed in claim 1, wherein, in step (A5), the upper unit further has a bottom stitching portion extending along a junction of the wing lateral mating edges and located on the bottom surface of the upper unit, and a rear end stitching portion extending along a junction of the main body rear end mating edges and located on a rear end of the peripheral surface of the upper unit.

3. The method as claimed in claim 1, further comprising step (I1) between step (H) and step (I), in which two decorative tightening plates are fixed to left and right sides of the sole.

4. The method as claimed in claim 3, further comprising step (I2) between step (I) and step (I1), in which the three-dimensional waterproof moisture-permeable upper structure is sleeved on the last.

5. The method as claimed in claim 4, wherein in step (I1), each of the decorative tightening plates having a bottom end portion connected to the sole, and a top end portion formed with a plurality of spaced-apart through holes.

6. The method as claimed in claim 5, further comprising, after step (I):

(J) pulling out the last from the three-dimensional moisture-permeable waterproof upper structure; and (K) removably threading a tightening strap through the through holes in the tightening plates to interconnect the decorative tightening plates.

7. The method as claimed in claim 1, wherein:

in step (B), the bonding agent is hot melt adhesive sprayed on the inner surface of the upper unit;

in step (D), the predetermined heating temperature is between 50° C. to 150° C., and the predetermined heating time is not less than 10 minutes;

in step (E), the predetermined vacuum time is between 20 to 60 seconds; and in step (F), the predetermined freezing temperature is between −5° C. to 5° C., and the predetermined freezing time is not less than 2 hours.

8. The method as claimed in claim 7, wherein, in step (D), the heating device is an oven, and in step (F), the freezing device is a freezer.

* * * * *